US010053758B2

(12) United States Patent
Bryan

(10) Patent No.: US 10,053,758 B2
(45) Date of Patent: Aug. 21, 2018

(54) PRODUCTION OF HIGH STRENGTH TITANIUM

(75) Inventor: David J. Bryan, Indian Trail, NC (US)

(73) Assignee: ATI Properties LLC, Albany, OR (US)

( * ) Notice: Subject to any disclaimer, the term of this patent is extended or adjusted under 35 U.S.C. 154(b) by 19 days.

(21) Appl. No.: 12/691,952

(22) Filed: Jan. 22, 2010

(65) Prior Publication Data

US 2011/0180188 A1 Jul. 28, 2011

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/18; C22F 1/183; C22C 14/00
USPC ..... 148/670
See application file for complete search history.

(56) References Cited

U.S. PATENT DOCUMENTS 2,857,269 A 10/1958 Vordahl
2,893,864 A 7/1959 Harris et al.
2,932,886 A 4/1960 Althouse
2,974,076 A 3/1961 Vordahl
3,015,292 A 1/1962 Bridwell
3,025,905 A 3/1962 Haerr
3,060,564 A 10/1962 Corral
3,082,083 A 3/1963 Levy et al.
3,117,471 A 1/1964 O'Connell et al.
3,313,138 A 4/1967 Spring et al.
3,379,522 A 4/1968 Vordahl
3,436,277 A * 4/1969 Bomberger, Jr. et al. .... 148/671
3,469,975 A 9/1969 Bomberger, Jr. et al.
3,489,617 A 1/1970 Wuerfel
3,584,487 A 6/1971 Carlson
3,605,477 A 9/1971 Carlson
3,615,378 A 10/1971 Bomberger, Jr. et al.
3,635,068 A 1/1972 Watmough et al.
3,649,259 A 3/1972 Heitman
3,676,225 A 7/1972 Owczarski et al.
3,686,041 A 8/1972 Lee
3,802,877 A 4/1974 Parris et al.
3,815,395 A 6/1974 Sass
3,835,282 A 9/1974 Sass et al.
3,922,899 A 12/1975 Fremont et al.
3,979,815 A 9/1976 Nakanose et al.
4,053,330 A 10/1977 Henricks et al.
4,067,734 A 1/1978 Curtis et al.
4,098,623 A 4/1978 Ibaraki et al.
4,094,708 A 6/1978 Hubbard et al.
4,120,187 A 10/1978 Mullen
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,309,226 A 1/1982 Chen
4,472,207 A 9/1984 Kinoshita et al.
4,473,125 A 9/1984 Addudle et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,769,087 A 9/1988 Genereux et al.
4,799,975 A 1/1989 Ouchi et al.
4,808,249 A 2/1989 Eyelon et al.
4,817,858 A 4/1989 Verpoort
4,842,653 A 6/1989 Wirth et al.
4,851,055 A 6/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
(Continued)

FOREIGN PATENT DOCUMENTS

CA 2787980 A 7/2011
CN 1070230 A 3/1993
(Continued)

OTHER PUBLICATIONS

U.S. Appl. No. 11/745,189, filed May 7, 2007.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Dec. 16, 2004 in U.S. Appl. No. 10/434,598.
Office Action dated Aug. 17, 2005 in U.S. Appl. No. 10/434,598.
Office Action dated Dec. 19, 2005 in U.S. Appl. No. 10/434,598.
Office Action dated Sep. 6, 2006 in U.S. Appl. No. 10/434,598.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
(Continued)

*Primary Examiner* — Edward Johnson
(74) *Attorney, Agent, or Firm* — K&L Gates LLP

(57) ABSTRACT

Certain embodiments of a method for increasing the strength and toughness of a titanium alloy include plastically deforming a titanium alloy at a temperature in an alpha-beta phase field of the titanium alloy to an equivalent plastic deformation of at least a 25% reduction in area. After plastically deforming the titanium alloy in the alpha-beta phase field, the titanium alloy is not heated to or above the beta transus temperature of the titanium alloy. After plastic deformation, the titanium alloy is heat treated at a heat treatment temperature less than or equal to the beta transus temperature minus 20° F. (11.1° C.).

28 Claims, 7 Drawing Sheets

(56) References Cited

U.S. PATENT DOCUMENTS 4,889,170 A 12/1989 Mae et al.
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,656,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewley et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,823,705 B2 11/2004 Fukada et al.
6,908,517 B2 6/2005 Segal et al.
6,918,971 B2 7/2005 Fujii et al.
6,932,877 B2 8/2005 Raymond et al.
6,971,256 B2 12/2005 Okada et al.
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hill
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.
7,536,892 B2 5/2009 Amino et al.
7,559,221 B2 7/2009 Horita et al.
7,601,232 B2 10/2009 Fonte
7,611,592 B2 11/2009 Davis et al.
7,708,841 B2 5/2010 Saller et al.
7,837,812 B2 11/2010 Marquardt et al.
7,947,136 B2 5/2011 Saller
7,984,635 B2 7/2011 Callebaut et al.
8,037,730 B2 10/2011 Polen et al.
8,128,764 B2 3/2012 Miracle et al.
8,211,548 B2 7/2012 Chun et al.
8,316,687 B2 11/2012 Slattery
8,336,359 B2 12/2012 Werz
8,408,039 B2 4/2013 Cao et al.
8,454,765 B2 6/2013 Saller et al.
8,551,264 B2 10/2013 Kosaka et al.
8,578,748 B2 11/2013 Huskamp et al.
8,597,442 B2 12/2013 Hebda et al.
8,608,913 B2 12/2013 Shim et al.
8,613,818 B2 12/2013 Forbes Jones et al.
8,652,400 B2 2/2014 Forbes Jones et al.
8,679,269 B2 3/2014 Goller et al.
8,919,168 B2 12/2014 Valiev et al.
9,034,247 B2 5/2015 Suzuki et al.
9,732,408 B2 8/2017 Sanz et al.
2001/0050117 A1* 12/2001 Oyama et al. ..... 148/421
2002/0033717 A1* 3/2002 Matsuo ..... 327/94
2003/0168138 A1 9/2003 Marquardt
2004/0099350 A1 5/2004 Manitone et al.
2004/0148997 A1 8/2004 Amino et al.
2004/0221929 A1 11/2004 Hebda et al.
2004/0250932 A1 12/2004 Briggs

(56) References Cited

U.S. PATENT DOCUMENTS

| | | | | |
|---|---|---|---|---|
| 2005/0047952 | A1 | 3/2005 | Coleman | |
| 2005/0145310 | A1 | 7/2005 | Bewlay et al. | |
| 2005/0257864 | A1* | 11/2005 | Marquardt et al. | 148/671 |
| 2006/0045789 | A1 | 3/2006 | Nasserrafi et al. | |
| 2006/0110614 | A1 | 5/2006 | Liimatainen | |
| 2006/0243356 | A1 | 11/2006 | Oikawa et al. | |
| 2007/0017273 | A1 | 1/2007 | Haug et al. | |
| 2007/0193662 | A1 | 8/2007 | Jablokov et al. | |
| 2007/0286761 | A1 | 12/2007 | Miracle et al. | |
| 2008/0000554 | A1 | 1/2008 | Yaguchi et al. | |
| 2008/0103543 | A1 | 5/2008 | Li et al. | |
| 2008/0107559 | A1 | 5/2008 | Nishiyama et al. | |
| 2008/0202189 | A1 | 8/2008 | Otaki | |
| 2008/0210345 | A1* | 9/2008 | Tetyukhin et al. | 148/421 |
| 2008/0264932 | A1 | 10/2008 | Hirota | |
| 2009/0000706 | A1 | 1/2009 | Huron et al. | |
| 2009/0183804 | A1 | 7/2009 | Zhao et al. | |
| 2009/0234385 | A1 | 9/2009 | Cichocki et al. | |
| 2010/0307647 | A1 | 12/2010 | Marquardt et al. | |
| 2011/0038751 | A1 | 2/2011 | Marquardt et al. | |
| 2012/0003118 | A1 | 1/2012 | Hebda et al. | |
| 2012/0012233 | A1 | 1/2012 | Bryan | |
| 2012/0024033 | A1 | 2/2012 | Bryan | |
| 2012/0067100 | A1 | 3/2012 | Stefansson et al. | |
| 2012/0076611 | A1 | 3/2012 | Bryan | |
| 2012/0076612 | A1 | 3/2012 | Bryan | |
| 2012/0076686 | A1 | 3/2012 | Bryan | |
| 2012/0279351 | A1 | 11/2012 | Gu et al. | |
| 2013/0062003 | A1 | 3/2013 | Shulkin et al. | |
| 2013/0118653 | A1 | 5/2013 | Bryan et al. | |
| 2013/0156628 | A1 | 6/2013 | Forbes Jones et al. | |
| 2013/0291616 | A1 | 11/2013 | Bryan | |
| 2014/0060138 | A1 | 3/2014 | Hebda et al. | |
| 2014/0076468 | A1 | 3/2014 | Marquardt et al. | |
| 2014/0076471 | A1 | 3/2014 | Forbes Jones et al. | |
| 2014/0116582 | A1 | 5/2014 | Forbes Jones et al. | |
| 2014/0238552 | A1 | 8/2014 | Forbes Jones et al. | |
| 2014/0255719 | A1 | 9/2014 | Forbes Jones et al. | |
| 2014/0260492 | A1 | 9/2014 | Thomas et al. | |
| 2014/0261922 | A1 | 9/2014 | Thomas et al. | |
| 2015/0129093 | A1 | 5/2015 | Forbes Jones et al. | |
| 2016/0047024 | A1 | 2/2016 | Bryan | |
| 2016/0122851 | A1 | 5/2016 | Jones et al. | |
| 2016/0138149 | A1 | 5/2016 | Bryan | |
| 2016/0201165 | A1 | 7/2016 | Foltz, IV | |
| 2017/0058387 | A1 | 3/2017 | Marquardt et al. | |
| 2017/0146046 | A1 | 5/2017 | Foltz, IV | |
| 2017/0218485 | A1 | 8/2017 | Jones et al. | |
| 2017/0321313 | A1 | 11/2017 | Thomas et al. | |
| 2017/0349977 | A1 | 12/2017 | Forbes Jones et al. | |
| 2018/0016670 | A1 | 1/2018 | Bryan | |

FOREIGN PATENT DOCUMENTS

| | | | |
|---|---|---|---|
| CN | 1194671 | A | 9/1998 |
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101684530 | A | 3/2010 |
| CN | 101637789 | A | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1471158 | A1 | 10/2004 |
| EP | 1605073 | A1 | 12/2005 |
| EP | 1612289 | A2 | 1/2006 |
| EP | 1375690 | B1 | 3/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847103 | | 9/1960 |
| GB | 1170997 | A | 11/1969 |
| GB | 1433306 | | 4/1976 |
| GB | 2151260 | A | 7/1985 |
| GB | 2337762 | A | 12/1999 |
| JP | 55-113865 | A | 9/1980 |
| JP | 57-62820 | A | 4/1982 |
| JP | 57-62846 | | 4/1982 |
| JP | 57-62846 | A | 4/1982 |
| JP | S58-210158 | A | 12/1983 |
| JP | 60-046358 | | 3/1985 |
| JP | 60-100655 | A | 6/1985 |
| JP | S61-060871 | | 3/1986 |
| JP | S61-217562 | A | 9/1986 |
| JP | 62-109956 | A | 5/1987 |
| JP | 62-127074 | A | 6/1987 |
| JP | 62-149859 | A | 7/1987 |
| JP | S62-227597 | A | 10/1987 |
| JP | S63-49302 | A | 3/1988 |
| JP | S63-188426 | A | 8/1988 |
| JP | H01-272750 | A | 10/1989 |
| JP | 1-279736 | A | 11/1989 |
| JP | 2-205661 | A | 8/1990 |
| JP | 3-134124 | A | 6/1991 |
| JP | H03-166350 | A | 7/1991 |
| JP | H03-264618 | A | 11/1991 |
| JP | 4-74856 | A | 3/1992 |
| JP | 4-103737 | A | 4/1992 |
| JP | 4-143236 | A | 5/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-21642 | A | 1/1999 |
| JP | H11-309521 | A | 11/1999 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-69591 | A | 3/2002 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2005-281855 | A | 10/2005 |
| JP | 2007-291488 | A | 11/2007 |
| JP | 2007-327118 | A | 12/2007 |
| JP | 2008-200730 | A | 9/2008 |
| JP | 2009-138218 | A | 6/2009 |
| JP | 2009-299110 | A | 12/2009 |
| JP | 2009-299120 | | 12/2009 |

(56) References Cited

FOREIGN PATENT DOCUMENTS

| | | | |
|---|---|---|---|
| JP | 2010-70833 | A | 4/2010 |
| JP | 2012-140690 | A | 7/2012 |
| JP | 2015-54332 | A | 3/2015 |
| KR | 920004946 | | 6/1992 |
| KR | 10-2005-0087765 | A | 8/2005 |
| KR | 10-2009-0069647 | A | 7/2009 |
| RU | 2003417 | C1 | 11/1993 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2217260 | C1 | 11/2003 |
| RU | 2234998 | C1 | 8/2004 |
| RU | 2269584 | C1 | 2/2006 |
| RU | 2288967 | C1 | 12/2006 |
| RU | 2364660 | C1 | 8/2009 |
| RU | 2368695 | C1 | 9/2009 |
| RU | 2378410 | C1 | 1/2010 |
| RU | 2392348 | C2 | 6/2010 |
| RU | 2393936 | C1 | 7/2010 |
| RU | 2441089 | C1 | 1/2012 |
| SU | 534518 | A1 | 1/1977 |
| SU | 631234 | A | 11/1978 |
| SU | 1077328 | A | 5/1982 |
| SU | 1135798 | A1 | 1/1985 |
| SU | 1088397 | A1 | 2/1991 |
| UA | 38805 | A | 5/2001 |
| UA | 40862 | A | 8/2001 |
| UA | a200613448 | | 6/2008 |
| WO | WO 98/17386 | A1 | 4/1998 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2009/082498 | A1 | 7/2009 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Apr. 1, 2010 in U.S. Appl. No. 11/745,189.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., Nov. 9-10, 2004 Abstract, p. 12.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marquardt, Brian, "Characterization of Ti—15Mo for Orthopaedic Applications," TMS 2005 Annual Meeting: Technical Program, San Francisco, CA, Feb. 13-17, 2005 Abstract, p. 239.
Imperial Metal Industries Limited, Product Specification for "IMI Titanium 205", The Kynoch Press (England) pp. 1-5. (publication date unknown).
Qazi, J.I. et al., "High-Strength Metastable Beta-Titanium Alloys for Biomedical Applications," JOM, Nov. 2004 pp. 49-51.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Allegheny Ludlum, "High Performance Metals for Industry, High Strength, High Temperature, and Corrosion-Resistant Alloys", (2000) pp. 1-8.
Disegi, John, Wrought Titanium-15% Molybdenum Implant Material, Original Instruments and Implants of the Association for the Study of International Fixation—AO ASIF, Oct. 2003.
Naik, Uma M. et al., "Omega and Alpha Precipitation in Ti—15Mo Alloy," Titanium '80 Science and Technology—Proceedings of the 4th International Conference on Titanium, H. Kimura & O. Izumi Eds. May 19-22, 1980 pp. 1335-1341.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. May 19-22, 1980 pp. 1344-1350.
Bowen, A. W., "On the Strengthening of A Metastable b-Titanium Alloy by w- and a-Precipitation" Royal Aircraft Establishment Technical Memorandum Mat 338, (1980) pp. 1-15 and Figs 1-5.
Bowen, A. W., "Omega Phase Embrittlement in Aged Ti—15%Mo," Scripta Metallurgica, vol. 5, No. 8 (1971) pp. 709-715.
"ASTM Designation F2066-01 Standard Specification for Wrought Titanium-15 Molybdenum Alloy for Surgical Implant Applications (UNS R58150)," ASTM International (2000) pp. 1-4.
Disegi, J. A., "Titanium Alloys for Fracture Fixation Implants," Injury International Journal of the Care of the Injured, vol. 31 (2000) pp. S-D14-17.
Ho, W.F. et al., "Structure and Properties of Cast Binary Ti—Mo Alloys" Biomaterials, vol. 20 (1999) pp. 2115-2122.
ASM Materials Engineering Dictionary, J.R. Davis Ed., ASM International, Materials Park, OH (1992) p. 39.
Allvac, Product Specification for "Allvac Ti-15 Mo," available at http://www.allvac.com/allvac/pages/Titanium/Ti15MO.htm, last visited Jun. 9, 2003 p. 1 of 1.
Lemons, Jack et al., "Metallic Biomaterials for Surgical Implant Devices," BONEZone, Fall (2002) p. 5-9 and Table.
"ASTM Designation F1801-97 Standard Practice for Corrosion Fatigue Testing of Metallic Implant Materials" ASTM International (1997) pp. 876-880.
Zardiackas, L.D. et al., "Stress Corrosion Cracking Resistance of Titanium Implant Materials," Transactions of the 27th Annual Meeting of the Society for Biomaterials, (2001).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
ATI Ti—15Mo Beta Titanium Alloy Technical Data Sheet, ATI Allvac, Monroe, NC, Mar. 21, 2008, 3 pages.
Lütjering, G. And J.C. Williams, Titanium, Springer, New York (2nd ed. 2007) p. 24.
Murray, J.L., The Mn—Ti (Manganese-Titanium) System, Bulletin of Alloy Phase Diagrams, vol. 2, No. 3 (1981) p. 334-343.
Semiatin, S.L. et al., "The Thermomechanical Processing of Alpha/Beta Titanium Alloys," Journal of Metals, Jun. 1997, pp. 33-39.
Weiss, I. et al., "Thermomechanical Processing of Beta Titanium Alloys—An Overview," Material Science and Engineering, A243, 1998, pp. 46-65.
Weiss, I. et al., "The Processing Window Concept of Beta Titanium Alloys", Recrystallization '90, ed. by T. Chandra, The Minerals, Metals & Materials Society, 1990, pp. 609-616.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Myers, J., "Primary Working, A lesson from Titanium and its Alloys," ASM Course Book 27 Lesson, Test 9, Aug. 1994, pp. 3-4.

(56) References Cited

OTHER PUBLICATIONS

Metals Handbook, Desk Edition, 2nd ed., J. R. Davis ed., ASM International, Materials Park, Ohio (1998), pp. 575-588.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Russo, P.A., "Influence of Ni and Fe on the Creep of Beta Annealed Ti-6242S", Titanium '95: Science and Technology, pp. 1075-1082.
Williams, J., Thermo-mechanical processing of high-performance Ti alloys: recent progress and future needs, Journal of Material Processing Technology, 117 (2001), p. 370-373.
Lutjering, G. and Williams, J.C., Titanium, Springer-Verlag, 2003, Ch. 5: Alpha+Beta Alloys, p. 177-201.
Boyer, Rodney R., "Introduction and Overview of Titanium and Titanium Alloys: Applications," Metals Handbook, ASM Handbooks Online (2002).
Callister, Jr., William D., Materials Science and Engineering, An Introduction, Sixth Edition, John Wiley & Sons, pp. 180-184 (2003).
"Heat Treating of Nonferrous Alloys: Heat Treating of Titanium and Titanium Alloys," Metals Handbook, ASM Handbooks Online (2002).
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Long, M. et al., "Friction and Surface Behavior of Selected Titanium Alloys During Reciprocating-Sliding Motion", WEAR, 249(1-2), 158-168.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Lampman, S., "Wrought and Titanium Alloys," ASM Handbooks Online, ASM International, 2002.
Roach, M.D., et al., "Comparison of the Corrosion Fatigue Characteristics of CPTi-Grade 4, Ti—6A1—4V ELI, Ti—6A1-7 Nb, and Ti-15 Mo", Journal of Testing and Evaluation, vol. 2, Issue 7, (Jul./Aug. 2005) (published online Jun. 8, 2005).
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Marquardt et al., "Beta Titanium Alloy Processed for High Strength Orthopaedic Applications," Journal of ASTM International, vol. 2, Issue 9 (Oct. 2005) (published online Aug. 17, 2005).
SAE Aerospace Material Specification 4897A (issued Jan. 1997, revised Jan. 2003).
"Datasheet: Timetal 21S", Alloy Digest, Advanced Materials and Processes (Sep. 1998), pp. 38-39.
"Stryker Orthopaedics TMZF® Alloy (UNS R58120)", printed from www.allvac.com/allvac/pages/Titanium/UNSR58120.htm.
ASTM Designation F 2066-01, "Standard Specification for Wrought Titanium-15 Molybdenum Alloy for Surgical Implant Applications (UNS R58150)" 7 pages.
"Technical Data Sheet: Allvac® Ti—15Mo Beta Titanium Alloy" (dated Jun. 16, 2004).
"Allvac TiOsteum and TiOstalloy Beat Titanium Alloys", printed from www.allvac.com/allvac/pages/Titanium/TiOsteum.htm.
Donachie Jr., M.J., "Titanium a Technical Guide" 1988, ASM, pp. 38-39 and 46-50.
Standard Specification for Wrought Titanium—6Aluminum—4Vanadium Alloy for Surgical Implant Applications (UNS R56400), Designation: F 1472-99, ASTM 1999, pp. 1-4.
Two new α-β titanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Murray JL, et al., Binary Alloy Phase Diagrams, Second Edition, vol. 1, Ed. Massalski, Materials Park, OH; ASM International; 1990, p. 547.
Materials Properties Handbook: Titanium Alloys, Eds. Boyer et al, ASM International, Materials Park, OH, 1994, pp. 524-525.
Tamirisakandala et al., "Powder Metallurgy Ti—Al—4V—xB Alloys: Processing, Microstructure, and Properties", JOM, May 2004, pp. 60-63.
Tamirisakandala et al., "Effect of boron on the beta transus of Ti—Al—4V alloy", Scripta Materialia, 53, 2005, pp. 217-222.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Nyakana, et al., "Quick Reference Guide for β Titanium Alloys in the 00s", Journal of Materials Engineering and Performance, vol. 14, No. 6, Dec. 1, 2005, pp. 799-811.
Office Action dated Jun. 21, 2010 in U.S. Appl. No. 11/057,614.
Notice of Allowance dated Sep. 3, 2010 in U.S. Appl. No. 11/057,614.
Interview summary dated Jun. 3, 2010 in U.S. Appl. No. 11/745,189.
Interview summary dated Jun. 15, 2010 in U.S. Appl. No. 11/745,189.
Office Action dated Nov. 24, 2010 in U.S. Appl. No. 11/745,189.
Interview summary dated Jan. 6, 2011 in U.S. Appl. No. 11/745,189.
Office Action dated Jan. 11, 2011 in U.S. Appl. No. 12/911,947.
Veeck, S., et al., "The Castability of Ti-5553 Alloy," Advanced Materials and Processes, Oct. 2004.
ATI Allvac, ATI Ti—15Mo Beta Titanium Alloy Technical Data Sheet, Mar. 21, 2008.
AL-6XN® Alloy (UNS N08367) Allegheny Ludlum Corporation, 2002, 56 pages.
ATI Datalloy 2 Alloy, Technical Data Sheet, ATI Allvac, Monroe, NC, SS-844, Version1, Sep. 17, 2010, 8 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066/F2066M-13, "Standard Specification for Wrought Titanium-15 Molybdenum Alloy for Surgical Implant Applications (UNS R58150)", Nov. 2013, 6 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Titanium Alloy, Grade 38 Technical Data Sheet, Version 1, Feb. 1, 2012, pp. 1-6.
Beal et al., "Forming of Titanium and Titanium Alloys—Cold Forming", ASM Handbook, 2006, ASM International, vol. 14B, 2 pages.
Bewley, et al., "Superplastic roll forming of Ti alloys", Materials and Design, 21, 2000, pp. 287-295.

(56) References Cited

OTHER PUBLICATIONS

Desrayaud et al., "A novel high straining process for bulk materials—The development of a multipass forging system by compression along three axes", Journal of Materials Processing Technology, 172, 2006, pp. 152-158.
DiDomizio, et al., "Evaluation of a Ni—20Cr Alloy Processed by Multi-axis Forging", Materials Science Forum vols. 503-504, 2006, pp. 793-798.
Elements of Metallurgy and Engineering Alloys, Editor F. C. Campbell, ASM International, 2008, Chapter 8, p. 125.
Gigliotti et al., "Evaluation of Superplastically Roll Formed VT-25", Titamium'99, Science and Technology, 2000, pp. 1581-1588.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Marte et al., "Structure and Properties of Ni—20CR Produced by Severe Plastic Deformation", Ultrafine Grained Materials IV, 2006, pp. 419-424.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.08Si) Titanium Alloy datasheet, accessed Jun. 26, 2012.
TIMET TIMETAL® 6-2-4-6 Titanium Alloy (Ti—6Al—2Sn—4Zr—6Mo), Typical, accessed Jun. 26, 2012.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Office Action dated May 31, 2013 in U.S. Appl. No. 12/911,947.
Notice of Allowance dated Oct. 4, 2013 in U.S. Appl. No. 12/911,947.
Notice of Allowance dated Jul. 1, 2013 in U.S. Appl. No. 12/857,789.
Office Action dated Jun. 13, 2013 in U.S. Appl. No. 12/885,620.
Office Action dated Nov. 19, 2013 in U.S. Appl. No. 12/885,620.
Advisory Action Before the Filing of an Appeal Brief dated Jan. 30, 2014 in U.S. Appl. No. 12/885,620.
Office Action dated Jul. 18, 2013 in U.S. Appl. No. 12/838,674.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31, 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 1, 2013 in U.S. Appl. No. 12/903,851.
Office Action dated Jan. 16, 2014 in U.S. Appl. No. 12/903,851.
Office Action date Mar. 25, 2013 in U.S. Appl. No. 13/108,045.
Office Action dated Jan. 17, 2014 in U.S. Appl. No. 13/108,045.
Office Action dated Apr. 16, 2013 in U.S. Appl. No. 13/150,494.
Office Action date Jun. 14, 2013 in U.S. Appl. No. 13/150,494.
Notice of Allowance dated Nov. 5, 2013 in U.S. Appl. No. 13/150,494.
Supplemental Notice of Allowability dated Jan. 17, 2014 in U.S. Appl. No. 13/150,494.
U.S. Appl. No. 13/777,066, filed Feb. 26, 2013.
U.S. Appl. No. 13/331,135, filed Dec. 20, 2011.
U.S. Appl. No. 13/792,285, filed Mar. 11, 2013.
U.S. Appl. No. 13/844,196, filed Mar. 15, 2013.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
Office Action dated Sep. 6, 2013 in U.S. Appl. No. 13/933,222.
Notice of Allowance dated Oct. 1, 2013 in U.S. Appl. No. 13/933,222.
U.S. Appl. No. 14/077,699, filed Nov. 12, 2013.
U.S. Appl. No. 14/093,707, filed Dec. 2, 2013.
U.S. Appl. No. 13/844,545, filed Mar. 15, 2013.
Gilbert et al., "Heat Treating of Titanium and Titanium Alloys—Solution Treating and Aging", ASM Handbook, 1991, ASM International, vol. 4, pp. 1-8.
ATI Ti—I 5Mo Beta Titanium Alloy, Technical Data Sheet, Mar. 21, 2008, pp. 1-3.
Office Action dated Sep. 19, 2012 in U.S. Appl. No. 12/911,947.
Advisory Action dated Nov. 29, 2012 in U.S. Appl. No. 12/911,947.
Office Action dated Nov. 14, 2012 in U.S. Appl. No. 12/885,620.
Office Action dated Nov. 14, 2012 in U.S. Appl. No. 12/888,699.
Office Action dated Oct. 3, 2012 in U.S. Appl. No. 12/838,674.
Office Action dated Sep. 26, 2012 in U.S. Appl. No. 12/845,122.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Office Action dated Jun. 18, 2014 in U.S. Appl. No. 12/885,620.
Notice of Allowance dated May 6, 2014 in U.S. Appl. No. 13/933,222.

(56) References Cited

OTHER PUBLICATIONS

Cain, Patrick, "Warm forming aluminum magnesium components; How it can optimize formability, reduce springback", Aug. 1, 2009, from http://www.thefabricator.com/article/presstechnology/warm-forrning-aluminum-magnesium-components, 3 pages.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Duflou et al., "A method for force reduction in heavy duty bending", Int. J. Materials and Product Technology, vol. 32, No. 4, 2008, pp. 460-475.
Imatani et al., "Experiment and simulation for thick-plate bending by high frequency inductor", ACTA Metallurgica Sinica, vol. 11, No. 6, Dec. 1998, pp. 449-455.
Rudnev et at., "Longitudinal flux indication heating of slabs, bars and strips is no longer "Black Magic:" II", Industrial Heating, Feb. 1995, pp. 46-48 and 50-51.
Nguyen et al., "Analysis of bending deformation in triangle heating of steel plates with induction heating process using laminated plate theory", Mechanics Based Design of Structures and Machines, 37, 2009, pp. 228-246.
Lee et al., "An electromagnetic and thermo-mechanical analysis of high frequency induction heating for steel plate bending", Key Engineering Materials, vols. 326-328, 2006, pp. 1283-1286.
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
ATI 425®-MIL Alloy, Technical Data Sheet, Version 1, May 28, 2010, pp. 1-5.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Titanium 6Al—2Sn—4Zr—2Mo Alloy, Technical Data Sheet, Version 1, Sep. 17, 2010, pp. 1-3.
ATI Aerospace Materials Development, Mission Critical Metallics, Apr. 30, 2008, 17 pages.
Shahan et al., "Adiabatic shear bands in titanium and titanium alloys: a critical review", Materials & Design, vol. 14, No. 4, 1993, pp. 243-250.
Zhang et al., "Simulation of slip band evolution in duplex Ti—6Al—4V", Acta Materialia, vol. 58, 2010, pp. 1087-1096.
ATI 425®-MIL Titanium Alloy, Mission Critical Metallics®, Version 3, Sep. 10, 2009, pp. 1-4.
ATI Wah Chang, Titanium and Titanium Alloys, Technical Data Sheet, 2003, pp. 1-16.
ATI Wah Chang, ATI™ 425 Titanium Alloy (Ti—4Al—2.5V—1.5Fe—0.2502), Technical Data Sheet, 2004, pp. 1-5.
ATI Titanium 6Al—4V Alloy, Mission Critical Metallics®, Technical Data Sheet, Version 1, Apr. 22, 2010, pp. 1-3.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
ATI 425®-MIL Alloy, Technical Data Sheet, Version 2, Aug. 16, 2010, 5 pages.
SPS Titanium™ Titanium Fasteners, SPS Technologies Aerospace Fasteners, 2003, 4 pages.
Altemp® A286 Iron-Base Superalloy (UNS Designation S66286) Allegheny Ludlum Technical Data Sheet Blue Sheet, 1998, 8 pages.
Zeng et al., Evaluation of Newly Developed Ti-555 High Strength Titanium Fasteners, 17th AeroMat Conference & Exposition, May 18, 2006, 2 pages.
Nishimura, T. "Ti—15Mo—5Zr—3Al", Materials Properties Handbook: Titanium Alloys, eds. R. Boyer et al., ASM International, Materials Park, OH, 1994, p. 949.
Notice of Allowance dated Sep. 20, 2010 in U.S. Appl. No. 11/448,160.
Notice of Allowance dated Jun. 27, 2011 in U.S. Appl. No. 11/745,189.
Office Action dated Nov. 16, 2011 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7, 2011 in U.S. Appl. No. 12/857,789.
U.S. Appl. No. 13/230,046, filed Sep. 12, 2011.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Technical Presentation: Overview of MMPDS Characterization of ATI 425 Alloy, 2012, 1 page.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
Advisory Action dated Jan. 25, 2012 in U.S. Appl. No. 12/911,947.
Notice of Panel Decision from Pre-Appeal Brief Review dated Mar. 28, 2012 in U.S. Appl. No. 12/911,947.
Office Action dated Apr. 5, 2012 in U.S. Appl. No. 12/911,947.
ATI 38-644™ Beta Titanium Alloy Technical Data Sheet, UNS R58640, Version 1, Dec. 21, 2011, 4 pages.
ATI 425® Alloy, Grade 38, Titanium Alloy, UNS R54250, Technical Data Sheet, Version 1, Nov. 25, 2013, pp. 1-6.
Beal et al., "Forming of Titanium and Titanium Alloys—Cold Forming", ASM Handbook, 2006, ASM International, Revised by ASM Committee on Forming Titanium Alloys, vol. 14B, 2 pages.
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Diderrich et al., "Addition of Cobalt to the Ti—6Al—4V Alloy", Journal of Metals, May 1968, pp. 29-37.
Hsieh, Chih-Chun and Weite Wu, "Overview of Intermetallic Sigma Phase Precipitation in Stainless Steels", ISRN Metallurgy, vol. 2012, 2012, pp. 1-16.
Swann, P.R. and J. G. Parr, "Phase Transformations in Titanium-Rich Alloys of Titanium and Cobalt", Transactions of the Metallurgical Society of AIME, Apr. 1958, pp. 276-279.
Ti—6Al—4V, Ti64, 6Al—4V, 6-4, UNS R56400, 1 page.
Titanium 3A—8V—6Cr—4Mo—4Zr Beta-C/Grade 19 UNS R58640, 2 pages.
Yakymyshyn et al., "The Relationship between the Constitution and Mechanical Properties of Titanium-Rich Alloys of Titanium and Cobalt", 1961,vol. 53, pp. 283-294.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.

(56) References Cited

OTHER PUBLICATIONS

Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Office Action dated Nov. 28, 2014 in U.S. Appl. No. 12/885,620.
Office Action dated Oct. 6, 2014 in U.S. Appl. No. 12/903,851.
Office Action dated Jan. 21, 2015 in U.S. Appl. No. 13/792,285.
Notice of Allowance dated Oct. 24, 2014 in U.S. Appl. No. 13/844,545.
Notice of Allowance dated Feb. 6, 2015 in U.S. Appl. No. 13/844,545.
U.S. Appl. No. 14/594,300, filed Jan. 12, 2015.
Glazunov et al., Structural Titanium Alloys, Moscow, Metallurgy, 1974, pp. 264-283.
Novikov et al., 17.2.2 Deformable ($\alpha+\beta$) alloys, Chapter 17, Titanium and its Alloys, Metal Science, vol. II Thermal Treatment of the Alloy, Physical Matallurgy, 2009, pp. 357-360.
Notice of Allowance dated Sep. 25, 2015 in U.S. Appl. No. 12/838,674.
Notice of Allowance dated Jun. 4, 2015 in U.S. Appl. No. 13/792,285.
Notice of Allowance dated Sep. 2, 2015 in U.S. Appl. No. 13/714,465.
Office Action dated Oct. 5, 2015 in U.S. Appl. No. 13/777,066.
Beal et al., "Forming of Titanium and Titanium Alloys—Cold Forming", ASM Handbook, 2006, vol. 14B, pp. 656-669.
Donachie Jr., M.J., "Heat Treating Titanium and Its Alloys", Heat Treating Process, Jun./Jul. 2001, pp. 47-49, 52-53, and 56-57.
Advisory Action dated May 18, 2015 in U.S. Appl. No. 12/885,620.
Office Action dated Jun. 30, 2015 in U.S. Appl. No. 12/885,620.
Office Action dated May 27, 2015 in U.S. Appl. No. 12/838,674.
Applicant Initiated Interview Summary dated Sep. 1, 2015 in U.S. Appl. No. 12/838,674.
Office Action dated Jul. 15, 2015 in U.S. Appl. No. 12/903,851.
Office Action dated Jun. 4, 2015 in U.S. Appl. No. 13/792,285.
Office Action dated Jun. 3, 2015 in U.S. Appl. No. 13/714,465.
Office Action dated Jul. 8, 2015 in U.S. Appl. No. 13/714,465.
Office Action dated Jun. 26, 2015 in U.S. Appl. No. 13/777,066.
Office Action dated Aug. 19, 2015 in U.S. Appl. No. 13/844,196.
ASM Materials Engineering Dictionary, "Blasting or Blast Cleaning," J.R. Davis Ed., ASM International, Materials Park, OH (1992) p. 42.
Valiev et al., "Nanostructured materials produced by sever plastic deformation", Moscow, Logos, 2000.
Li et al., "The optimal determination of forging process parameters for Ti—6.5Al—3.5Mo—1.52r—0.3Si alloy with thick lamellar microstructure in two phase field based on P-map", Journal of Materials Processing Technology, vol. 210, Issue 2, Jan. 19, 2010, pp. 370-377.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
Inconel® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http://www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin,1992, 3 pages.
Acom Magazine, outokumpu, NACE International, Feb. 2013, 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.
ATI 3-2.5™ Titanium (Ti Grade 9) Technical Data Sheet, ATI Wah Chang, 2010, 4 pages.
Grade 9 Ti 3Al 2.5V Alloy (UNS R56320), Jul. 30, 2013, http://www.azom.com/article.aspx?ArticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy, Jul. 9, 2013, http://www.azom.com/article.aspx?ArticleID=9448, 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL® 54M", Henderson Technical Laboratory, Titanium Metals Corporation, ITA, Oct. 2010, Orlando, Florida, 18 pages.
ATI Datalloy HP™ Alloy, UNS N08830, Technical Data Sheet Version 1, Apr. 14, 2015, 6 pages.
ATI Datalloy 2® Alloy, Technical Data Sheet, Version 1, Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Notice of Abandonment dated Jan. 29, 2016 in U.S. Appl. No. 12/885,620.
Office Action dated Mar. 30, 2016 in U.S. Appl. No. 13/108,045.
Response to Rule 312 Communication dated Oct. 20, 2015 in U.S. Appl. No. 13/792,285.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Advisory Action Before the Filing of an Appeal Brief dated Mar. 17, 2016 in U.S. Appl. No. 13/777,066.
Office Action dated Oct. 15, 2015 in U.S. Appl. No. 13/844,196.
Office Action dated Feb. 12, 2016 in U.S. Appl. No. 13/844,196.
Office Action dated Oct. 2, 2015 in U.S. Appl. No. 14/073,029.
Office Action dated Oct. 28, 2015 in U.S. Appl. No. 14/093,707.
Office Action dated Mar. 17, 2016 in U.S. Appl. No. 14/093,707.
Notice of Third-Party Submission dated Dec. 16, 2015 in U.S. Appl. No. 14/077,699.
Office Action dated Mar. 16, 2016 in U.S. Appl. No. 15/005,281.
U.S. Appl. No. 14/948,941, filed Nov. 23, 2015.
Office Action dated Apr. 5, 2016 in U.S. Appl. No. 14/028,588.
Office Action dated Apr. 13, 2016 in U.S. Appl. No. 14/083,759.
Office Action dated May 6, 2016 in U.S. Appl. No. 14/083,759.
Examiner's Answer to Appeal Brief dated Oct. 27, 2016 in U.S. Appl. No. 12/903,851.
Office Action dated Dec. 29, 2016 in U.S. Appl. No. 13/844,196.
Office Action dated Sep. 30, 2016 in U.S. Appl. No. 14/093,707.
Notice of Allowance dated Jan. 13, 2017 in U.S. Appl. No. 14/093,707.
Supplemental Notice of Allowance dated Jan. 27, 2017 in U.S. Appl. No. 14/093,707.

(56) References Cited

OTHER PUBLICATIONS

Supplemental Notice of Allowance dated Feb. 10, 2017 in U.S. Appl. No. 14/093,707.
Office Action dated Oct. 25, 2016 in U.S. Appl. No. 14/077,699.
Advisory Action dated Nov. 30, 2016 in U.S. Appl. No. 14/077,699.
Advisory Action dated Oct. 14, 2016 in U.S. Appl. No. 14/028,588.
Applicant Initiated Interview Summary dated Oct. 27, 2016 in U.S. Appl. No. 14/028,588.
Notice of Allowance dated Oct. 13, 2016 in U.S. Appl. No. 14/083,759.
U.S. Appl. No. 15/348,140, filed Nov. 10, 2016.
Notice of Allowance dated Dec. 16, 2016 in U.S. Appl. No. 14/922,750.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://wvvw.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Office Action dated Sep. 9, 2016 in U.S. Appl. No. 13/108,045.
Office Action dated Jul. 22, 2016 in U.S. Appl. No. 13/777,066.
Advisory Action Before the Filing of an Appeal Brief dated Jun. 15, 2016 in U.S. Appl. No. 13/844,196.
Office Action dated Aug. 22, 2016 in U.S. Appl. No. 13/844,196.
Office Action dated Aug. 12, 2016 in U.S. Appl. No. 14/073,029.
Advisory Action Before the Filing of an Appeal Brief dated Jun. 10, 2016 in U.S. Appl. No. 14/093,707.
Office Action dated Jul. 25, 2016 in U.S. Appl. No. 14/077,699.
Office Action dated Aug. 16, 2016 in U.S. Appl. No. 14/077,699.
Office Action dated Aug. 26, 2016 in U.S. Appl. No. 15/005,281.
Office Action dated Aug. 8, 2016 in U.S. Appl. No. 14/028,588.
Srinivasan et al., "Rolling of Plates and Sheets from As-Cast Ti—6Al—4V—0.1 B", Journal of Materials Engineering and Performance, vol. 18.4, Jun. 2009, pp. 390-398.
Advisory Action dated Mar. 7, 2017 in U.S. Appl. No. 13/108,045.
Office Action dated Oct. 12, 2016 in U.S. Appl. No. 13/777,066.
Office Action dated May 18, 2017 in U.S. Appl. No. 13/777,066.
Office Action dated Jun. 14, 2017 in U.S. Appl. No. 14/073,029.
Supplemental Notice of Allowability dated Mar. 1, 2017 in U.S. Appl. No. 14/093,707.
Notice of Panel Decision from Pre-Appeal Brief Review dated Feb. 24, 2017 in U.S. Appl. No. 15/005,281.
Office Action dated Mar. 2, 2017 in U.S. Appl. No. 15/005,281.
Office Action dated Mar. 15, 2017 in U.S. Appl. No. 14/028,588.
Notice of Allowance dated Feb. 28, 2017 in U.S. Appl. No. 14/922,750.
Office Action dated Apr. 10, 2017 in U.S. Appl. No. 14/594,300.
Office Action dated May 25, 2017 in U.S. Appl. No. 14/594,300.
Markovsky, P. E., "Preparation and properties of ultrafine (submicron) structure titanium alloys", Materials Science and Engineering, 1995, A203, 4 pages.
Advisory Action Before the Filing of an Appeal Brief dated Jul. 10, 2017 in U.S. Appl. No. 13/777,066.
Notice of Allowance dated Aug. 30, 2017 in U.S. Appl. No. 13/777,066.
Notice of Allowance dated Jul. 13, 2017 in U.S. Appl. No. 13/844,196.
Corrected Notice of Allowability dated Jul. 20, 2017 in U.S. Appl. No. 13/844,196.
Corrected Notice of Allowability dated Aug. 18, 2017 in U.S. Appl. No. 13/844,196.
Notice of Allowance dated Jul. 7, 2017 in U.S. Appl. No. 14/073,029.
Notice of Allowability dated Sep. 21, 2017 in U.S. Appl. No. 14/073,029.
Notice of Allowance dated May 10, 2017 U.S. Appl. No. 15/005,281.
Corrected Notice of Allowability dated Aug. 9, 2017 in U.S. Appl. No. 15/005,281.
Office Action dated Jul. 14, 2017 in U.S. Appl. No. 14/028,588.
Advisory Action dated Sep. 12, 2017 in U.S. Appl. No. 14/028,588.
Office Action dated Sep. 13, 2017 in U.S. Appl. No. 14/594,300.
Gil et al., "Formation of alpha-Widmanstatten structure: effects of grain size and cooling rate on the Widmanstatten morphologies and on the mechanical properties in Ti6Al4V alloy", Journal of Alloys and Compounds, 329, 2001, pp. 142-152.
Enayati et al., "Effects of temperature and effective strain on the flow behavior of Ti—6Al—4V". Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment, ed. Yang Man, China Machine Press, Apr. 2008, pp. 265-266.
Decision on Appeal dated Dec. 15, 2017 in U.S. Appl. No. 12/903,851.
Office Action dated Feb. 27, 2018 in U.S. Appl. No. 13/108,045.
Corrected Notice of Allowability dated Dec. 20, 2017 in U.S. Appl. No. 13/777,066.
Office Action dated Dec. 1, 2017 in U.S. Appl. No. 14/077,699.
Notice of Panel Decision from Pre-Appeal Brief Review dated Oct. 27, 2017 in U.S. Appl. No. 14/028,588.
Notice of Allowance dated Feb. 9. 2018 in U.S. Appl. No. 14/028,588.
Advisory Action dated Jan. 26, 2018 in U.S. Appl. No. 14/594,300.
Office Action dated Feb. 28, 2018 in U.S. Appl. No. 14/594,300.
Office Action dated Oct. 31, 2017 in U.S. Appl. No. 15/653,985.
Office Action dated Dec. 6, 2017 in U.S. Appl. No. 14/948,941.
Office Action dated Feb. 15, 2018 in U.S. Appl. No. 14/948,941.
U.S. Appl. No. 15/816,128, filed Nov. 17, 2017.

* cited by examiner

PRODUCTION OF HIGH STRENGTH TITANIUM

BACKGROUND OF THE TECHNOLOGY

Field of the Technology

The present disclosure is directed to methods for producing titanium alloys having high strength and high toughness. The methods according to the present disclosure do not require the multi-step heat treatments used in certain existing titanium alloy production methods.

Description of the Background of the Technology

Titanium alloys typically exhibit a high strength-to-weight ratio, are corrosion resistant, and are resistant to creep at moderately high temperatures. For these reasons, titanium alloys are used in aerospace and aeronautic applications including, for example, critical structural parts such as landing gear members and engine frames. Titanium alloys also are used in jet engines for parts such as rotors, compressor blades, hydraulic system parts, and nacelles.

Pure titanium undergoes an allotropic phase transformation at about 882° C. Below this temperature, titanium adopts a hexagonally close-packed crystal structure, referred to as the α phase. Above this temperature, titanium has a body centered cubic structure, referred to as the β phase. The temperature at which the transformation from the α phase to the β phase takes place is referred to as the beta transus temperature ($T_\beta$). The beta transus temperature is affected by interstitial and substitutional elements and, therefore, is dependent upon impurities and, more importantly, alloying elements.

In titanium alloys, alloying elements are generally classified as α stabilizing elements or β stabilizing elements. Addition of α stabilizing elements ("α stabilizers") to titanium increases the beta transus temperature. Aluminum, for example, is a substitutional element for titanium and is an α stabilizer. Interstitial alloying elements for titanium that are α stabilizers include, for example, oxygen, nitrogen, and carbon.

Addition of β stabilizing elements to titanium lowers the beta transus temperature. β stabilizing elements can be either β isomorphous elements or β eutectoid elements, depending on the resulting phase diagrams. Examples of β isomorphous alloying elements for titanium are vanadium, molybdenum, and niobium. By alloying with sufficient concentrations of these β isomorphous alloying elements, it is possible to lower the beta transus temperature to room temperature or lower. Examples of β eutectoid alloying elements are chromium and iron. Additionally, other elements, such as, for example, silicon, zirconium, and hafnium, are neutral in the sense that these elements have little effect on the beta transus temperature of titanium and titanium alloys.

FIG. 1A depicts a schematic phase diagram showing the effect of adding an α stabilizer to titanium. As the concentration of α stabilizer increases, the beta transus temperature also increases, which is seen by the positive slope of the beta transus temperature line 10. The beta phase field 12 lies above the beta transus temperature line 10 and is an area of the phase diagram where only β phase is present in the titanium alloy. In FIG. 1A, an alpha-beta phase field 14 lies below the beta transus temperature line 10 and represents an area on the phase diagram where both α phase and β phase (α+β) are present in the titanium alloy. Below the alpha-beta phase field 14 is the alpha phase field 16, where only α phase is present in the titanium alloy.

FIG. 1B depicts a schematic phase diagram showing the effect of adding an isomorphous β stabilizer to titanium.

Higher concentrations of β stabilizers reduce the beta transus temperature, as is indicated by the negative slope of the beta transus temperature line 10. Above the beta transus temperature line 10 is the beta phase field 12. An alpha-beta phase field 14 and an alpha phase field 16 also are present in the schematic phase diagram of titanium with isomorphous β stabilizer in FIG. 1B.

FIG. 10 depicts a schematic phase diagram showing the effect of adding a eutectoid β stabilizer to titanium. The phase diagram exhibits a beta phase field 12, a beta transus temperature line 10, an alpha-beta phase field 14, and an alpha phase field 16. In addition, there are two additional two-phase fields in the phase diagram of FIG. 10, which contain either α phase or β phase together with the reaction product of titanium and the eutectoid β stabilizing alloying addition (Z).

Titanium alloys are generally classified according to their chemical composition and their microstructure at room temperature. Commercially pure (CP) titanium and titanium alloys that contain only α stabilizers such as aluminum are considered alpha alloys. These are predominantly single phase alloys consisting essentially of α phase. However, CP titanium and other alpha alloys, after being annealed below the beta transus temperature, generally contain about 2-5 percent by volume of β phase, which is typically stabilized by iron impurities in the alpha titanium alloy. The small volume of β phase is useful in the alloy for controlling the recrystallized α phase grain size.

Near-alpha titanium alloys have a small amount of β phase, usually less than 10 percent by volume, which results in increased room temperature tensile strength and increased creep resistance at use temperatures above 400° C., compared with the alpha alloys. An exemplary near-alpha titanium alloy may contain about 1 weight percent molybdenum.

Alpha/beta (α+β) titanium alloys, such as Ti-6Al-4V (Ti 6-4) alloy and Ti-6Al-2Sn-4Zr-2Mo (Ti 6-2-4-2) alloy, contain both alpha and beta phase and are widely used in the aerospace and aeronautics industries. The microstructure and properties of alpha/beta alloys can be varied through heat treatments and thermomechanical processing.

Stable beta titanium alloys, metastable beta titanium alloys, and near beta titanium alloys, collectively classified as "beta alloys", contain substantially more β stabilizing elements than alpha/beta alloys. Near-beta titanium alloys, such as, for example, Ti-10V-2Fe-3Al alloy, contain amounts of β stabilizing elements sufficient to maintain an all-β phase structure when water quenched, but not when air quenched. Metastable beta titanium alloys, such as, for example, Ti-15Mo alloy, contain higher levels of β stabilizers and retain an all-β phase structure upon air cooling, but can be aged to precipitate α phase for strengthening. Stable beta titanium alloys, such as, for example, Ti-30Mo alloy, retain an all-β phase microstructure upon cooling, but cannot be aged to precipitate α phase.

It is known that alpha/beta alloys are sensitive to cooling rates when cooled from above the beta transus temperature. Precipitation of α phase at grain boundaries during cooling reduces the toughness of these alloys. Currently, the production of titanium alloys having high strength and high toughness requires the use of a combination of high temperature deformations followed by a complicated multi-step heat treatment that includes carefully controlled heating rates and direct aging. For example, U.S. Patent Application Publication No. 2004/0250932 A1 discloses forming a titanium alloy containing at least 5% molybdenum into a utile shape at a first temperature above the beta transus temperature, or heat treating a titanium alloy at a first temperature above the beta transus temperature followed by controlled cooling at a rate of no more than 5° F. (2.8° C.) per minute to a second temperature below the beta transus temperature. The titanium alloy also may be heat treated at a third temperature.

A temperature-versus-time schematic plot of a typical prior art method for producing tough, high strength titanium alloys is shown in FIG. 2. The method generally includes an elevated temperature deformation step conducted below the beta transus temperature, and a heat treatment step including heating above the beta transus temperature followed by controlled cooling. The prior art thermomechanical processing steps used to produce titanium alloys having both high strength and high toughness are expensive, and currently only a limited number of manufacturers have the capability to conduct these steps. Accordingly, it would be advantageous to provide an improved process for increasing strength and/or toughness of titanium alloys.

SUMMARY

According to one aspect of the present disclosure, a non-limiting embodiment of a method for increasing the strength and toughness of a titanium alloy includes plastically deforming a titanium alloy at a temperature in the alpha-beta phase field of the titanium alloy to an equivalent plastic deformation of at least a 25% reduction in area. After plastically deforming the titanium alloy at a temperature in the alpha-beta phase field, the titanium alloy is not heated to a temperature at or above a beta transus temperature of the titanium alloy. Further according to the non-limiting embodiment, after plastically deforming the titanium alloy, the titanium alloy is heat treated at a heat treatment temperature less than or equal to the beta transus temperature minus 20° F. for a heat treatment time sufficient to produce a heat treated alloy having a fracture toughness ($K_{Ic}$) that is related to the yield strength (YS) according to the equation $K_{Ic} \geq 173-(0.9)YS$. In another non-limiting embodiment, the titanium alloy may be heat treated after plastic deformation at a temperature in the alpha-beta phase field of the titanium alloy to an equivalent plastic deformation of at least a 25% reduction in area at a heat treatment temperature less than or equal to the beta transus temperature minus 20° F. for a heat treatment time sufficient to produce a heat treated alloy having a fracture toughness ($K_{Ic}$) that is related to the yield strength (YS) according to the equation $K_{Ic} \geq 217.6-(0.9)YS$.

According to another aspect of the present disclosure, a non-limiting method for thermomechanically treating a titanium alloy includes working a titanium alloy in a working temperature range of 200° F. (111° C.) above the beta transus temperature of the titanium alloy to 400° F. (222° C.) below the beta transus temperature. In a non-limiting embodiment, at the conclusion of the working step an equivalent plastic deformation of at least 25% reduction in area may occur in an alpha-beta phase field of the titanium alloy, and the titanium alloy is not heated above the beta transus temperature after the equivalent plastic deformation of at least 25% reduction in area in the alpha beta phase field of the titanium alloy. According to one non-limiting embodiment, after working the titanium alloy, the alloy may be heat treated in a heat treatment temperature range between 1500° F. (816° C.) and 900° F. (482° C.) for a heat treatment time of between 0.5 and 24 hours. The titanium alloy may be heat treated in a heat treatment temperature range between 1500° F. (816° C.) and 900° F. (482° C.) for a heat treatment time sufficient to produce a heat treated alloy having a fracture toughness ($K_{Ic}$) that is related to the yield strength (YS) of the heat treated alloy according to the equation $K_{Ic} \geq 173-(0.9)YS$ or, in another non-limiting embodiment, according to the equation $K_{Ic} \geq 217.6-(0.9)YS$.

According to yet another aspect of the present disclosure, a non-limiting embodiment of a method for processing titanium alloys comprises working a titanium alloy in an alpha-beta phase field of the titanium alloy to provide an equivalent plastic deformation of at least a 25% reduction in area of the titanium alloy. In one non-limiting embodiment of the method, the titanium alloy is capable of retaining beta-phase at room temperature. In a non-limiting embodiment, after working the titanium alloy, the titanium alloy may be heat treated at a heat treatment temperature no greater than the beta transus temperature minus 20° F. for a heat treatment time sufficient to provide the titanium alloy with an average ultimate tensile strength of at least 150 ksi and a $K_{Ic}$ fracture toughness of at least 70 ksi·in$^{1/2}$. In a non-limiting embodiment, the heat treatment time is in the range of 0.5 hours to 24 hours.

Yet a further aspect of the present disclosure is directed to a titanium alloy that has been processed according to a method encompassed by the present disclosure. One non-limiting embodiment is directed to a Ti-5Al-5V-5Mo-3Cr alloy that has been processed by a method according to the present disclosure including steps of plastically deforming and heat treating the titanium alloy, and wherein the heat treated alloy has a fracture toughness ($K_{Ic}$) that is related to the yield strength (YS) of the heat treated alloy according to the equation $K_{Ic} \geq 217.6-(0.9)YS$. As is known in the art, Ti-5Al-5V-5Mo-3Cr alloy, which also is known as Ti-5553 alloy or Ti 5-5-5-3 alloy, includes nominally 5 weight percent aluminum, 5 weight percent vanadium, 5 weight percent molybdenum, 3 weight percent chromium, and balance titanium and incidental impurities. In one non-limiting embodiment, the titanium alloy is plastically deformed at a temperature in the alpha-beta phase field of the titanium alloy to an equivalent plastic deformation of at least a 25% reduction in area. After plastically deforming the titanium alloy at a temperature in the alpha-beta phase field, the titanium alloy is not heated to a temperature at or above a beta transus temperature of the titanium alloy. Also, in one non-limiting embodiment, the titanium alloy is heat treated at a heat treatment temperature less than or equal to the beta transus temperature minus 20° F. (11.1° C.) for a heat treatment time sufficient to produce a heat treated alloy having a fracture toughness ($K_{Ic}$) that is related to the yield strength (YS) of the heat treated alloy according to the equation $K_{Ic} \geq 217.6-(0.9)YS$.

Yet another aspect according to the present disclosure is directed to an article adapted for use in at least one of an aeronautic application and an aerospace application and comprising a Ti-5Al-5V-5Mo-3Cr alloy that has been processed by a method including plastically deforming and heat treating the titanium alloy in a manner sufficient so that a fracture toughness ($K_{Ic}$) of the heat treated alloy is related to a yield strength (YS) of the heat treated alloy according to the equation $K_{Ic} \geq 217.6-(0.9)YS$. In a non-limiting embodiment, the titanium alloy may be plastically deformed at a temperature in the alpha-beta phase field of the titanium alloy to an equivalent plastic deformation of at least a 25% reduction in area. After plastically deforming the titanium alloy at a temperature in the alpha-beta phase field, the titanium alloy is not heated to a temperature at or above a beta transus temperature of the titanium alloy. In a non-limiting embodiment, the titanium alloy may be heat treated at a heat treatment temperature less than or equal to (i.e., no greater than) the beta transus temperature minus 20° F. (11.1° C.) for a heat treatment time sufficient to produce a heat treated alloy having a fracture toughness ($K_{Ic}$) that is related to the yield strength (YS) of the heat treated alloy according to the equation $K_{Ic} \geq 217.6-(0.9)YS$.

BRIEF DESCRIPTION OF THE DRAWINGS

The features and advantages of methods described herein may be better understood by reference to the accompanying drawings in which.

Figure 1A:
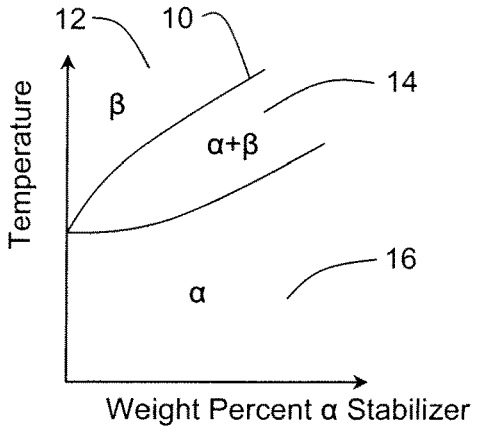
FIG. 1A Prior Art
FIG. 1A is an example of a phase diagram for titanium alloyed with an alpha stabilizing element.

The reader will appreciate the foregoing details, as well as others, upon considering the following detailed description of certain non-limiting embodiments of methods according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the methods for producing high strength, high toughness titanium alloys according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Certain non-limiting embodiments according to the present disclosure are directed to thermomechanical methods for producing tough and high strength titanium alloys and that do not require the use of complicated, multi-step heat treatments. Surprisingly, and in contrast to the complex thermomechanical processes presently and historically used with titanium alloys, certain non-limiting embodiments of thermomechanical methods disclosed herein include only a high temperature deformation step followed by a one-step heat treatment to impart to titanium alloys combinations of tensile strength, ductility, and fracture toughness required in certain aerospace and aeronautical materials. It is anticipated that embodiments of thermomechanical processing within the present disclosure can be conducted at any facility that is reasonably well equipped to perform titanium thermomechanical heat treatment. The embodiments contrast with conventional heat treatment practices for imparting high toughness and high strength to titanium alloys, practices commonly requiring sophisticated equipment for closely controlling alloy cooling rates.

Figure 1B:
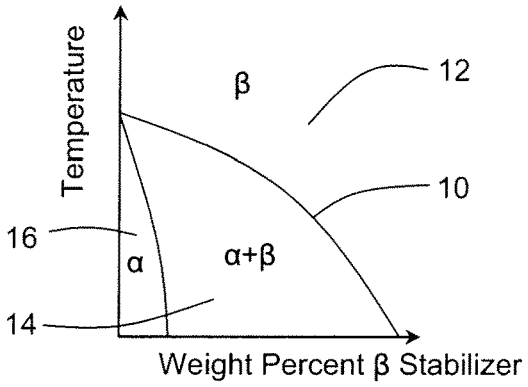
FIG. 1B Prior Art
FIG. 1B is an example of a phase diagram for titanium alloyed with an isomorphous beta stabilizing element.
Figure 1C:
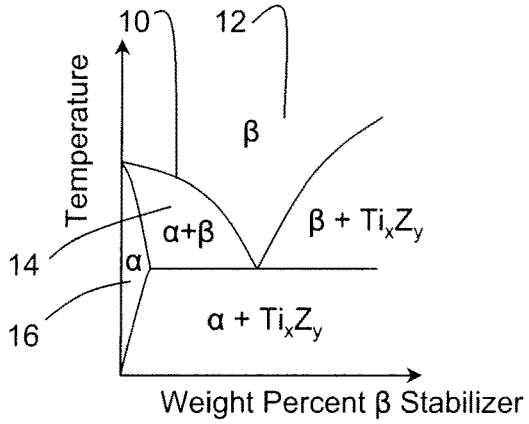
FIG. 1C Prior Art
FIG. 1C is an example of a phase diagram for titanium alloyed with a eutectoid beta stabilizing element.
Figure 2:
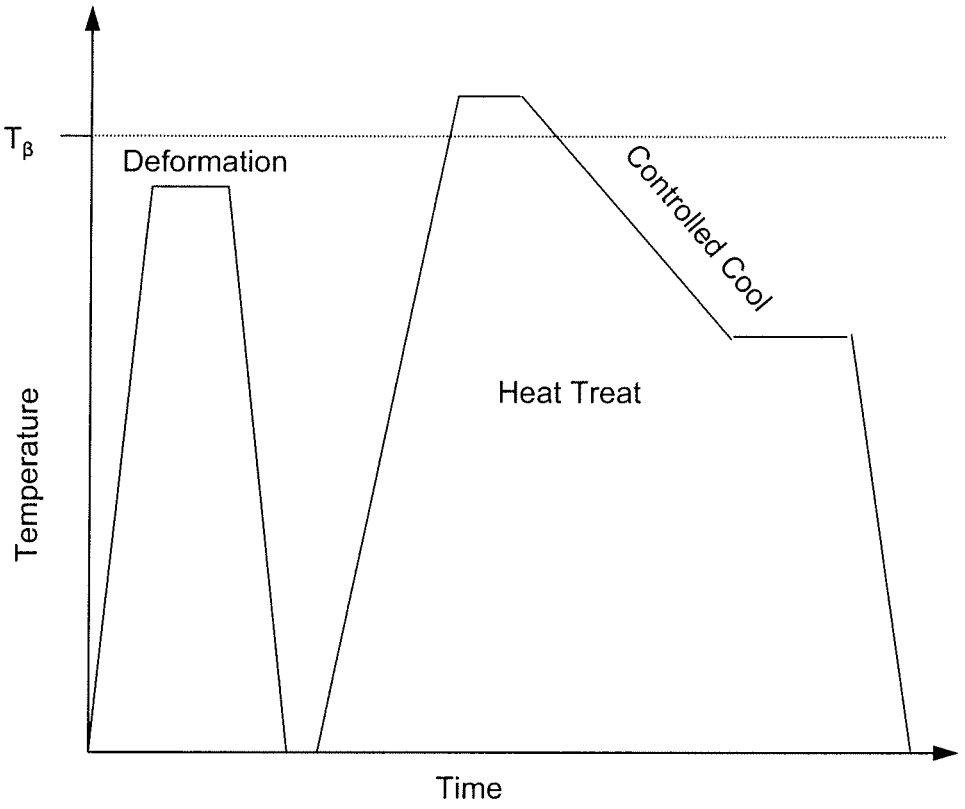
Prior Art FIG. 2
FIG. 2 is a schematic representation of a prior art thermomechanical processing scheme for producing tough, high-strength titanium alloys.
Figure 3:
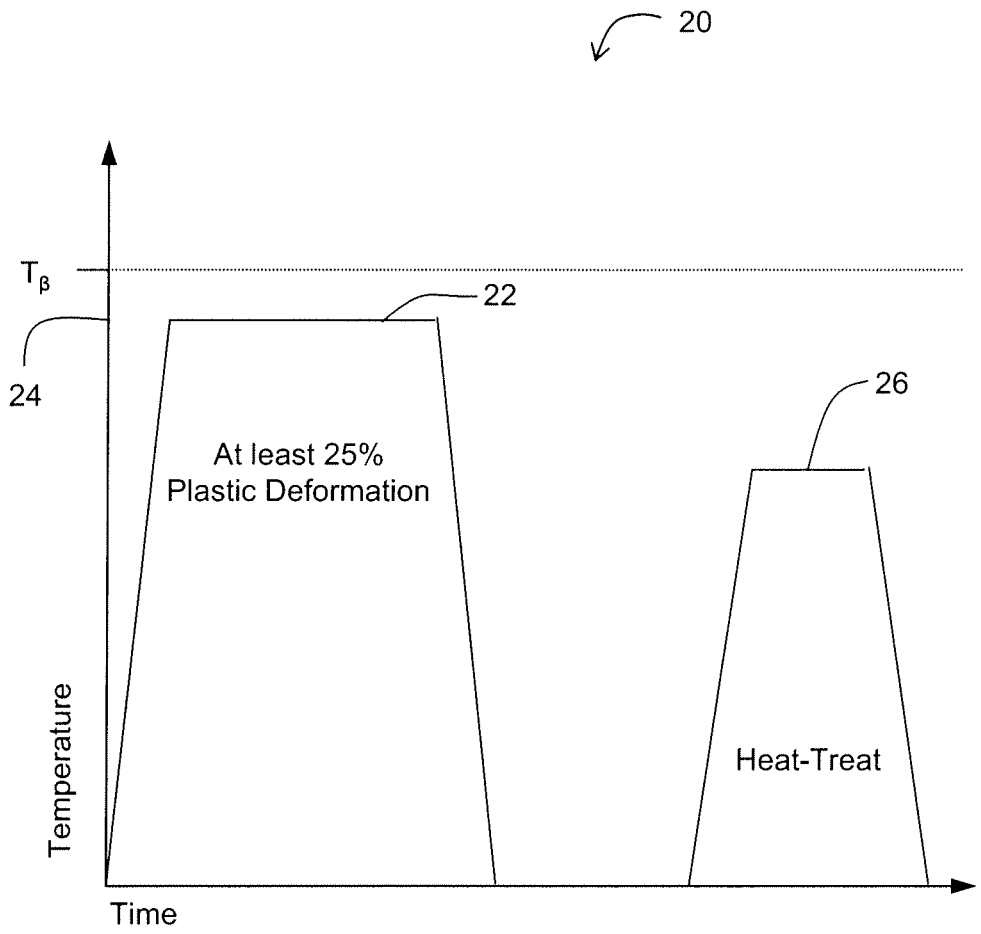
FIG. 3 is a time-temperature diagram of a non-limiting embodiment of a method according to the present disclosure comprising substantially all alpha-beta phase plastic deformation.

Referring to the schematic temperature versus time plot of FIG. 3, one non-limiting method 20 according to the present disclosure for increasing the strength and toughness of a titanium alloy comprises plastically deforming 22 a titanium alloy at a temperature in the alpha-beta phase field of the titanium alloy to an equivalent plastic deformation of at least a 25% reduction in area. (See FIGS. 1A-1C and the discussion above regarding the alpha-beta phase field of a titanium alloy.) The equivalent 25% plastic deformation in the alpha-beta phase field involves a final plastic deformation temperature 24 in the alpha-beta phase field. The term "final plastic deformation temperature" is defined herein as the temperature of the titanium alloy at the conclusion of plastically deforming the titanium alloy and prior to aging the titanium alloy. As further shown in FIG. 3, subsequent to the plastic deformation 22, the titanium alloy is not heated above the beta transus temperature ($T_\beta$) of the titanium alloy during the method 20. In certain non-limiting embodiments, and as shown in FIG. 3, subsequent to the plastic deformation at the final plastic deformation temperature 24, the titanium alloy is heat treated 26 at a temperature below the beta transus temperature for a time sufficient to impart high strength and high fracture toughness to the titanium alloy. In a non-limiting embodiment, the heat treatment 26 may be conducted at a temperature at least 20° F. below the beta transus temperature. In another non-limiting embodiment, the heat treatment 26 may be conducted at a temperature at least 50° F. below the beta transus temperature. In certain non-limiting embodiments, the temperature of the heat treatment 26 may be below the final plastic deformation temperature 24. In other non-limiting embodiments, not shown in FIG. 3, in order to further increase the fracture toughness of the titanium alloy, the temperature of the heat treatment may be above the final plastic deformation temperature, but less than the beta transus temperature. It will be understood that although FIG. 3 shows a constant temperature for the plastic deformation 22 and the heat treatment 26, in other non-limiting embodiments of a method according to the present disclosure the temperature of the plastic deformation 22 and/or the heat treatment 26 may vary. For example, a natural decrease in temperature of the titanium alloy workpiece occurs during plastic deformation is within the scope of embodiments disclosed herein. The schematic temperature—time plot of FIG. 3 illustrates that certain embodiments of methods of heat treating titanium alloys to impart high strength and high toughness disclosed herein contrast with conventional heat treatment practices for imparting high strength and high toughness to titanium alloys. For example, conventional heat treatment practices typically require multi-step heat treatments and sophisticated equipment for closely controlling alloy cooling rates, and are therefore expensive and cannot be practiced at all heat treatment facilities. The process embodiments illustrated by FIG. 3, however, do not involve multi-step heat treatment and may be conducted using conventional heat treating equipment.

Generally, the specific titanium alloy composition determines the combination of heat-treatment time(s) and heat treatment temperature(s) that will impart the desired mechanical properties using methods according to the present disclosure. Further, the heat treatment times and temperatures can be adjusted to obtain a specific desired balance of strength and fracture toughness for a particular alloy composition. In certain non-limiting embodiments disclosed herein, for example, by adjusting the heat treatment times and temperatures used to process a Ti-5Al-5V-5Mo-3Cr (Ti 5-5-5-3) alloy by a method according to the present disclosure, ultimate tensile strengths of 140 ksi to 180 ksi combined with fracture toughness levels of 60 ksi·in$^{1/2}$ $K_{Ic}$ to 100 ksi·in$^{1/2}$ $K_{Ic}$ were achieved. Upon considering the present disclosure, those having ordinary skill, may, without undue effort, determine the particular combination(s) of heat treatment time and temperature that will impart the optimal strength and toughness properties to a particular titanium alloy for its intended application.

The term "plastic deformation" is used herein to mean the inelastic distortion of a material under applied stress or stresses that strains the material beyond its elastic limit.

The term "reduction in area" is used herein to mean the difference between the cross-sectional area of a titanium alloy form prior to plastic deformation and the cross-sectional area of the titanium alloy form after plastic deformation, wherein the cross-section is taken at an equivalent location. The titanium alloy form used in assessing reduction in area may be, but is not limited to, any of a billet, a bar, a plate, a rod, a coil, a sheet, a rolled shape, and an extruded shape.

An example of a reduction in area calculation for plastically deforming a 5 inch diameter round titanium alloy billet by rolling the billet to a 2.5 inch round titanium alloy bar follows. The cross-sectional area of a 5 inch diameter round billet is π (pi) times the square of the radius, or approximately $(3.1415)\times(2.5\text{ inch})^2$, or 19.625 in$^2$. The cross-sectional area of a 2.5 inch round bar is approximately $(3.1415)\times(1.25)^2$, or 4.91 in$^2$. The ratio of the cross-section area of the starting billet to the bar after rolling is 4.91/19.625, or 25%. The reduction in area is 100%−25%, for a 75% reduction in area.

The term "equivalent plastic deformation" is used herein to mean the inelastic distortion of a material under applied stresses that strain the material beyond its elastic limit. Equivalent plastic deformation may involve stresses that would result in the specified reduction in area obtained with uniaxial deformation, but occurs such that the dimensions of the alloy form after deformation are not substantially different than the dimensions of the alloy form prior to deformation. For example, and without limitation, multi-axis forging may be used to subject an upset forged titanium alloy billet to substantial plastic deformation, introducing dislocations into the alloy, but without substantially changing the final dimensions of the billet. In a non-limiting embodiment wherein the equivalent plastic deformation is at least 25%, the actual reduction in area may by 5% or less. In a non-limiting embodiment wherein the equivalent plastic deformation is at least 25%, the actual reduction in area may by 1% or less. Multi-axis forging is a technique known to a person having ordinary skill in the art and, therefore, is not further described herein.

In certain non-limiting embodiments according to the present disclosure, a titanium alloy may be plastically deformed to an equivalent plastic deformation of greater than a 25% reduction in area and up to a 99% reduction in area. In certain non-limiting embodiments in which the equivalent plastic deformation is greater than a 25% reduction in area, at least an equivalent plastic deformation of a 25% reduction in area in the alpha-beta phase field occurs at the end of the plastic deformation, and the titanium alloy is not heated above the beta transus temperature ($T_\beta$) of the titanium alloy after the plastic deformation.

In one non-limiting embodiment of a method according to the present disclosure, and as generally depicted in FIG. 3, plastically deforming the titanium alloy comprises plastically deforming the titanium alloy so that all of the equivalent plastic deformation occurs in the alpha-beta phase field. Although FIG. 3 depicts a constant plastic deformation temperature in the alpha-beta phase field, it also is within the scope of embodiments herein that the equivalent plastic deformation of at least a 25% percent reduction in area in the alpha-beta phase field occurs at varying temperatures. For example, the titanium alloy may be worked in the alpha-beta phase field while the temperature of the alloy gradually decreases. It is also within the scope of embodiments herein to heat the titanium alloy during the equivalent plastic deformation of at least a 25% percent reduction in area in the alpha-beta phase field so as to maintain a constant or near constant temperature or limit reduction in the temperature of the titanium alloy, as long as the titanium alloy is not heated to or above the beta transus temperature of the titanium alloy. In a non-limiting embodiment, plastically deforming the titanium alloy in the alpha-beta phase region comprises plastically deforming the alloy in a plastic deformation temperature range of just below the beta transus temperature, or about 18° F. (10° C.) below the beta transus temperature to 400° F. (222° C.) below the beta transus temperature. In another non-limiting embodiment, plastically deforming the titanium alloy in the alpha-beta phase region comprises plastically deforming the alloy in a plastic deformation temperature range of 400° F. (222° C.) below the beta transus temperature to 20° F. (11.1° C.) below the beta transus temperature. In yet another non-limiting embodiment, plastically deforming the titanium alloy in the alpha-beta phase region comprises plastically deforming the alloy in a plastic deformation temperature range of 50° F. (27.8° C.) below the beta transus temperature to 400° F. (222° C.) below the beta transus temperature.

Figure 4:
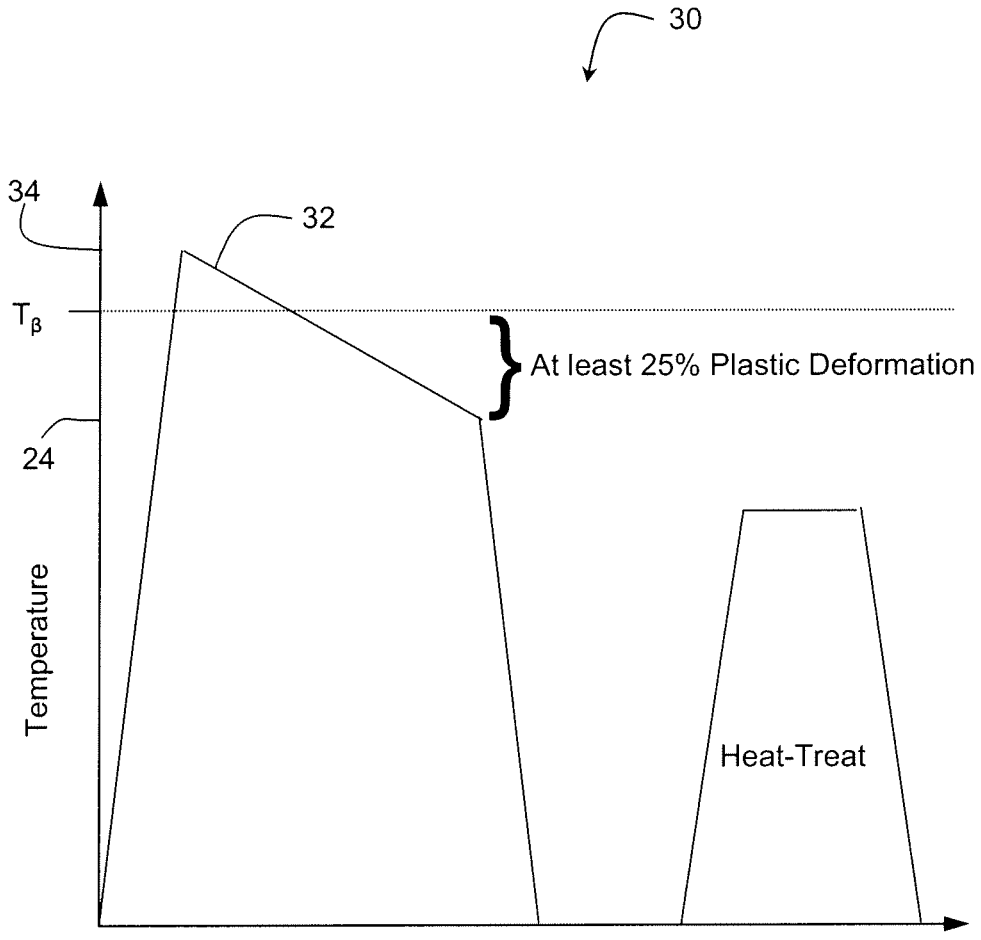
FIG. 4 is a time-temperature diagram of another non-limiting embodiment of a method according to the present disclosure comprising "through beta transus" plastic deformation.

Referring to the schematic temperature versus time plot of FIG. 4, another non-limiting method 30 according to the present disclosure includes a feature referred to herein as "through beta transus" processing. In non-limiting embodiments that include through beta transus processing, plastic deformation (also referred to herein as "working") begins with the temperature of the titanium alloy at or above the beta transus temperature ($T_\beta$) of the titanium alloy. Also, in through beta transus processing, plastic deformation 32 includes plastically deforming the titanium alloy from a temperature 34 that is at or above the beta transus temperature to a final plastic deformation temperature 24 that is in the alpha-beta phase field of the titanium alloy. Thus, the temperature of the titanium alloy passes "through" the beta transus temperature during the plastic deformation 32. Also, in through beta transus processing, plastic deformation equivalent to at least a 25% reduction in area occurs in the alpha-beta phase field, and the titanium alloy is not heated to a temperature at or above the beta transus temperature ($T_\beta$) of the titanium alloy after plastically deforming the titanium alloy in the alpha-beta phase field. The schematic temperature—time plot of FIG. 4 illustrates that non-limiting embodiments of methods of heat treating titanium alloys to impart high strength and high toughness disclosed herein contrast with conventional heat treatment practices for imparting high strength and high toughness to titanium alloys. For example, conventional heat treatment practices typically require multi-step heat treatments and sophisticated equipment for closely controlling alloy cooling rates, and are therefore expensive and cannot be practiced at all heat treatment facilities. The process embodiments illustrated by FIG. 4, however, do not involve multi-step heat treatment and may be conducted using conventional heat treating equipment.

In certain non-limiting embodiments of a method according to the present disclosure, plastically deforming the titanium alloy in a through beta transus process comprises plastically deforming the titanium alloy in a temperature range of 200° F. (111° C.) above the beta transus temperature of the titanium alloy to 400° F. (222° C.) below the beta transus temperature, passing through the beta transus temperature during the plastic deformation. The inventor has determined that this temperature range is effective as long as (i) a plastic deformation equivalent to at least a 25% reduction in area occurs in the alpha-beta phase field and (ii) the titanium alloy is not heated to a temperature at or above the beta transus temperature after the plastic deformation in the alpha-beta phase field.

In embodiments according to the present disclosure, the titanium alloy can be plastically deformed by techniques including, but not limited to, forging, rotary forging, drop forging, multi-axis forging, bar rolling, plate rolling, and extruding, or by combinations of two or more of these techniques. Plastic deformation can be accomplished by any suitable mill processing technique known now or hereinafter to a person having ordinary skill in the art, as long as the processing technique used is capable of plastically deforming the titanium alloy workpiece in the alpha-beta phase region to at least an equivalent of a 25% reduction in area.

As indicated above, in certain non-limiting embodiments of a method according to the present disclosure, the plastic deformation of the titanium alloy to at least an equivalent of a 25% reduction in area occurring in the alpha-beta phase region does not substantially change the final dimensions of the titanium alloy. This may be achieved by a technique such as, for example, multi-axis forging. In other embodiments, the plastic deformation comprises an actual reduction in area of a cross-section of the titanium alloy upon completion of the plastic deformation. A person skilled in the art realizes that the reduction in area of a titanium alloy resulting from plastic deformation at least equivalent to a reduction in area of 25% could result, for example, in actually changing the referenced cross-sectional area of the titanium alloy, i.e., an actual reduction in area, anywhere from as little as 0% or 1%, and up to 25%. Further, since the total plastic deformation may comprise plastic deformation equivalent to a reduction in area of up to 99%, the actual dimensions of the workpiece after plastic deformation equivalent to a reduction in area of up to 99% may produce an actual change in the referenced cross-sectional area of the titanium alloy of anywhere from as little as 0% or 1%, and up to 99%.

A non-limiting embodiment of a method according to the present disclosure comprises cooling the titanium alloy to room temperature after plastically deforming the titanium alloy and before heat treating the titanium alloy. Cooling can be achieved by furnace cooling, air cooling, water cooling, or any other suitable cooling technique known now or hereafter to a person having ordinary skill in the art.

An aspect of this disclosure is such that after hot working the titanium alloy according to embodiments disclosed herein, the titanium alloy is not heated to or above the beta transus temperature. Therefore, the step of heat treating does not occur at or above the beta transus temperature of the alloy. In certain non-limiting embodiments, heat treating comprises heating the titanium alloy at a temperature ("heat treatment temperature") in the range of 900° F. (482° C.) to 1500° F. (816° C.) for a time ("heat treatment time") in the range of 0.5 hours to 24 hours. In other non-limiting embodiments, in order to increase fracture toughness, the heat treatment temperature may be above the final plastic deformation temperature, but less than the beta transus temperature of the alloy. In another non-limiting embodiment, the heat treatment temperature ($T_h$) is less than or equal to the beta transus temperature minus 20° F. (11.1° C.), i.e., $T_h \leq (T_\beta - 20°\ F.)$. In another non-limiting embodiment, the heat treatment temperature ($T_h$) is less than or equal to the beta transus temperature minus 50° F. (27.8° C.), i.e., $T_h \leq (T_\beta - 50°\ F.)$. In still other non-limiting embodiments, a heat treatment temperature may be in a range from at least 900° F. (482° C.) to the beta transus temperature minus 20° F. (11.1° C.), or in a range from at least 900° F. (482° C.) to the beta transus temperature minus 50° F. (27.8° C.). It is understood that heat treatment times may be longer than 24 hours, for example, when the thickness of the part requires long heating times.

Another non-limiting embodiment of a method according to the present disclosure comprises direct aging after plastically deforming the titanium alloy, wherein the titanium alloy is cooled or heated directly to the heat treatment temperature after plastically deforming the titanium alloy in the alpha-beta phase field. It is believed that in certain non-limiting embodiments of the present method in which the titanium alloy is cooled directly to the heat treatment temperature after plastic deformation, the rate of cooling will not significantly negatively affect the strength and toughness properties achieved by the heat treatment step. In non-limiting embodiments of the present method in which the titanium alloy is heat treated at a heat treatment temperature above the final plastic deformation temperature, but below the beta transus temperature, the titanium alloy may be directly heated to the heat treatment temperature after plastically deforming the titanium alloy in the alpha-beta phase field.

Certain non-limiting embodiments of a thermomechanical method according to the present disclosure include applying the process to a titanium alloy that is capable of retaining β phase at room temperature. As such, titanium alloys that may be advantageously processed by various embodiments of methods according to the present disclosure include beta titanium alloys, metastable beta titanium alloys, near-beta titanium alloys, alpha-beta titanium alloys, and near-alpha titanium alloys. It is contemplated that the methods disclosed herein may also increase the strength and toughness of alpha titanium alloys because, as discussed above, even CP titanium grades include small concentrations of β phase at room temperature.

In other non-limiting embodiments of methods according to the present disclosure, the methods may be used to process titanium alloys that are capable of retaining β phase at room temperature, and that are capable of retaining or precipitating α phase after aging. These alloys include, but are not limited to, the general categories of beta titanium alloys, alpha-beta titanium alloys, and alpha alloys comprising small volume percentages of β phase.

Non-limiting examples of titanium alloys that may be processed using embodiments of methods according to the present disclosure include: alpha/beta titanium alloys, such as, for example, Ti-6Al-4V alloy (UNS Numbers R56400 and R54601) and Ti-6Al-2Sn-4Zr-2Mo alloy (UNS Numbers R54620 and R54621); near-beta titanium alloys, such as, for example, Ti-10V-2Fe-3Al alloy (UNS R54610)); and metastable beta titanium alloys, such as, for example, Ti-15Mo alloy (UNS R58150) and Ti-5Al-5V-5Mo-3Cr alloy (UNS unassigned).

After heat treating a titanium alloy according to certain non-limiting embodiments disclosed herein, the titanium alloy may have an ultimate tensile strength in the range of 138 ksi to 179 ksi. The ultimate tensile strength properties discussed herein may be measured according to the specification of ASTM E8-04, "Standard Test Methods for Tension Testing of Metallic Materials". Also, after heat treating a titanium alloy according to certain non-limiting embodiments of methods according to the present disclosure, the titanium alloy may have an $K_{Ic}$ fracture toughness in the range of 59 ksi·in$^{1/2}$ to 100 ksi·in$^{1/2}$. The $K_{Ic}$ fracture toughness values discussed herein may be measured according to the specification ASTM E399-08, "Standard Test Method for Linear-Elastic Plane-Strain Fracture Toughness K Ic of Metallic Materials". In addition, after heat treating a titanium alloy according to certain non-limiting embodiments within the scope of the present disclosure, the titanium alloy may have a yield strength in the range of 134 ksi to 170 ksi. Furthermore, after heat treating a titanium alloy according to certain non-limiting embodiments within the scope of the present disclosure, the titanium alloy may have a percent elongation in the range of 4.4% to 20.5%.

In general, advantageous ranges of strength and fracture toughness for titanium alloys that can be achieved by practicing embodiments of methods according to the present disclosure include, but are not limited to, ultimate tensile strengths from 140 ksi to 180 ksi with fracture toughness ranging from about 40 ksi·in$^{1/2}$ $K_{Ic}$ to 100 ksi·in$^{1/2}$ $K_{Ic}$, or ultimate tensile strengths of 140 ksi to 160 ksi with fracture toughness ranging from 60 ksi·in$^{1/2}$ $K_{Ic}$ to 80 ksi·in$^{1/2}$ $K_{Ic}$. Still in other non-limiting embodiments, advantageous ranges of strength and fracture toughness include ultimate tensile strengths of 160 ksi to 180 ksi with fracture toughness ranging from 40 ksi·in$^{1/2}$ $K_{Ic}$ to 60 ksi·in$^{1/2}$ $K_{Ic}$. Other advantageous ranges of strength and fracture toughness that can be achieved by practicing certain embodiments of methods according to the present disclosure include, but are not limited to: ultimate tensile strengths of 135 ksi to 180 ksi with fracture toughness ranging from 55 ksi·in$^{1/2}$ $K_{Ic}$ to 100 ksi·in$^{1/2}$ $K_{Ic}$; ultimate tensile strengths ranging from 160 ksi to 180 ksi with fracture toughness ranging from 60 ksi·in$^{1/2}$ $K_{Ic}$ to 90 ksi·in$^{1/2}$ $K_{Ic}$; and ultimate tensile strengths ranging from 135 ksi to 160 ksi with fracture toughness values ranging from 85 ksi·in$^{1/2}$ $K_{Ic}$ to 95 ksi·in$^{1/2}$ $K_{Ic}$.

In a non-limiting embodiment of a method according to the present disclosure, after heat treating the titanium alloy, the alloy has an average ultimate tensile strength of at least 166 ksi, an average yield strength of at least 148 ksi, a percent elongation of at least 6%, and a $K_{Ic}$ fracture toughness of at least 65 ksi·in$^{1/2}$. Other non-limiting embodiments of methods according to the present disclosure provide a heat-treated titanium alloy having an ultimate tensile strength of at least 150 ksi and a $K_{Ic}$ fracture toughness of at least 70 ksi·in$^{1/2}$. Still other non-limiting embodiments of methods according to the present disclosure provide a heat-treated titanium alloy having an ultimate tensile strength of at least 135 ksi and a fracture toughness of at least 55 ksi·in$^{1/2}$.

A non-limiting method according to the present disclosure for thermomechanically treating a titanium alloy comprises working (i.e., plastically deforming) a titanium alloy in a temperature range of 200° F. (111° C.) above a beta transus temperature of the titanium alloy to 400° F. (222° C.) below the beta transus temperature. During the final portion of the working step, an equivalent plastic deformation of at least a 25% reduction in area occurs in an alpha-beta phase field of the titanium alloy. After the working step, the titanium alloy is not heated above the beta transus temperature. In non-limiting embodiments, after the working step the titanium alloy may be heat treated at a heat treatment temperature ranging between 900° F. (482° C.) and 1500° F. (816° C.) for a heat treatment time ranging between 0.5 and 24 hours.

In certain non-limiting embodiments according to the present disclosure, working the titanium alloy provides an equivalent plastic deformation of greater than a 25% reduction in area and up to a 99% reduction in area, wherein an equivalent plastic deformation of at least 25% occurs in the alpha-beta phase region of the titanium alloy of the working step and the titanium alloy is not heated above the beta transus temperature after the plastic deformation. A non-limiting embodiment comprises working the titanium alloy in the alpha-beta phase field. In other non-limiting embodiments, working comprises working the titanium alloy at a temperature at or above the beta transus temperature to a final working temperature in the alpha-beta field, wherein the working comprises an equivalent plastic deformation of a 25% reduction in area in the alpha-beta phase field of the titanium alloy and the titanium alloy is not heated above the beta transus temperature after the plastic deformation.

In order to determine thermomechanical properties of titanium alloys that are useful for certain aerospace and aeronautical applications, data from mechanical testing of titanium alloys that were processed according to prior art practices at ATI Allvac and data gathered from the technical literature were collected. As used herein, an alloy has mechanical properties that are "useful" for a particular application if toughness and strength of the alloy are at least as high as or are within a range that is required for the application. Mechanical properties for the following alloys that are useful for certain aerospace and aeronautical application were collected: Ti-10V-2Fe-3-Al (Ti 10-2-3; UNS R54610), Ti-5Al-5V-5Mo-3Cr (Ti 5-5-5-3; UNS unassigned), Ti-6Al-2Sn-4Zr-2Mo alloy (Ti 6-2-4-2; UNS Numbers R54620 and R54621), Ti-6Al-4V (Ti 6-4; UNS Numbers R56400 and R54601), Ti-6Al-2Sn-4Zr-6Mo (Ti 6-2-4-6; UNS R56260), Ti-6Al-2Sn-2Zr-2Cr-2Mo-0.25Si (Ti 6-22-22; AMS 4898), and Ti-3Al-8V-6Cr-4Zr-4Mo (Ti 3-8-

6-4-4; AMS 4939, 4957, 4958). The composition of each of these alloys is reported in the literature and is well know. Typical chemical composition ranges, in weight percent, of non-limiting exemplary titanium alloys that are amenable to methods disclosed herein are presented in Table 1. It is understood that the alloys presented in Table 1 are only non-limiting examples of alloys that may exhibit increased strength and toughness when processed according to embodiments disclosed herein, and that other titanium alloys, recognized by a skilled practitioner now or hereafter, are also within the scope of the embodiments disclosed herein.

TABLE 1

(weight %)

| | Ti 10-2-3 | Ti-5-5-3 | Ti 6-2-4-2 | Ti 6-4 | Ti 6-2-4-6 | Ti 6-22-22 | Ti 3-8-6-4-4 | Ti-15M0 |
|---|---|---|---|---|---|---|---|---|
| Al | 2.6-3.4 | 4.0-6.3 | 5.5-6.5 | 5.5-6.75 | 5.5-6.5 | 5.5-6.5 | 3.0-4.0 | |
| V | 9.0-11.0 | 4.5-5.9 | | 3.5-4.5 | | | 7.5-8.5 | |
| Mo | | 4.5-5.9 | 1.80-2.20 | | 5.50-6.50 | 1.5-2.5 | 3.5-4.5 | 14.00-16.00 |
| Cr | | 2.0-3.6 | | | | 1.5-2.5 | 5.5-6.5 | |
| Cr + Mo | | | | | | 4.0-5.0 | | |
| Zr | | 0.01-0.08 | 3.60-4.40 | | 3.50-4.50 | 1.5-2.5 | 3.5-4.5 | |
| Sn | | | 1.80-2.20 | | 1.75-2.25 | 1.5-2.5 | | |
| Si | | | | | | 0.2-0.3 | | |
| C | 0.05 max | 0.01-0.25 | 0.05 max | 0.1 max | 0.04 max | 0.05 max | 0.05 max | 0.10 max |
| N | 0.05 max | | 0.05 max | 0.05 max | 0.04 max | 0.04 max | | 0.05 max |
| O | 0.13 max | 0.03-0.25 | 0.15 max | 0.20 max | 0.15 max | 0.14 max | 0.14 | |
| H | 0.015 max | | 0.0125 max | 0.015 max | 0.0125 max | 0.01 max | 0.020 max | 0.015 max |
| Fe | 1.6-2.2 | 0.2-0.8 | 0.25 max | 0.40 max | 0.15 max | | 0.3 max | 0.1 max |
| Ti | rem | rem | rem | rem | rem | rem | rem | rem |

Figure 5:
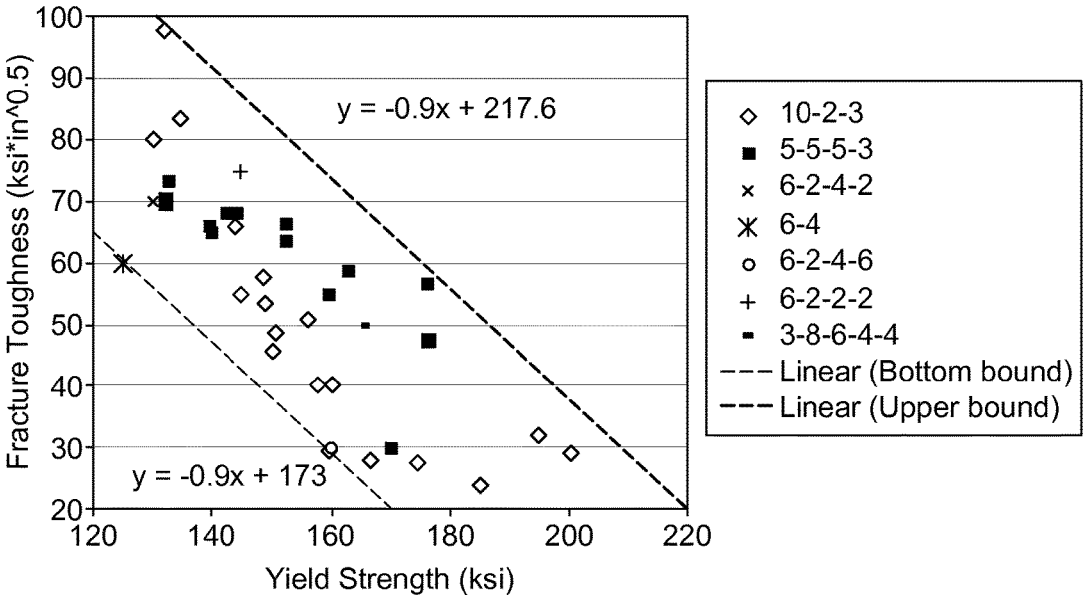
FIG. 5 is a graph of $K_{Ic}$ fracture toughness versus yield strength for various titanium alloys heat treated according to prior art processes.
Figure 6:
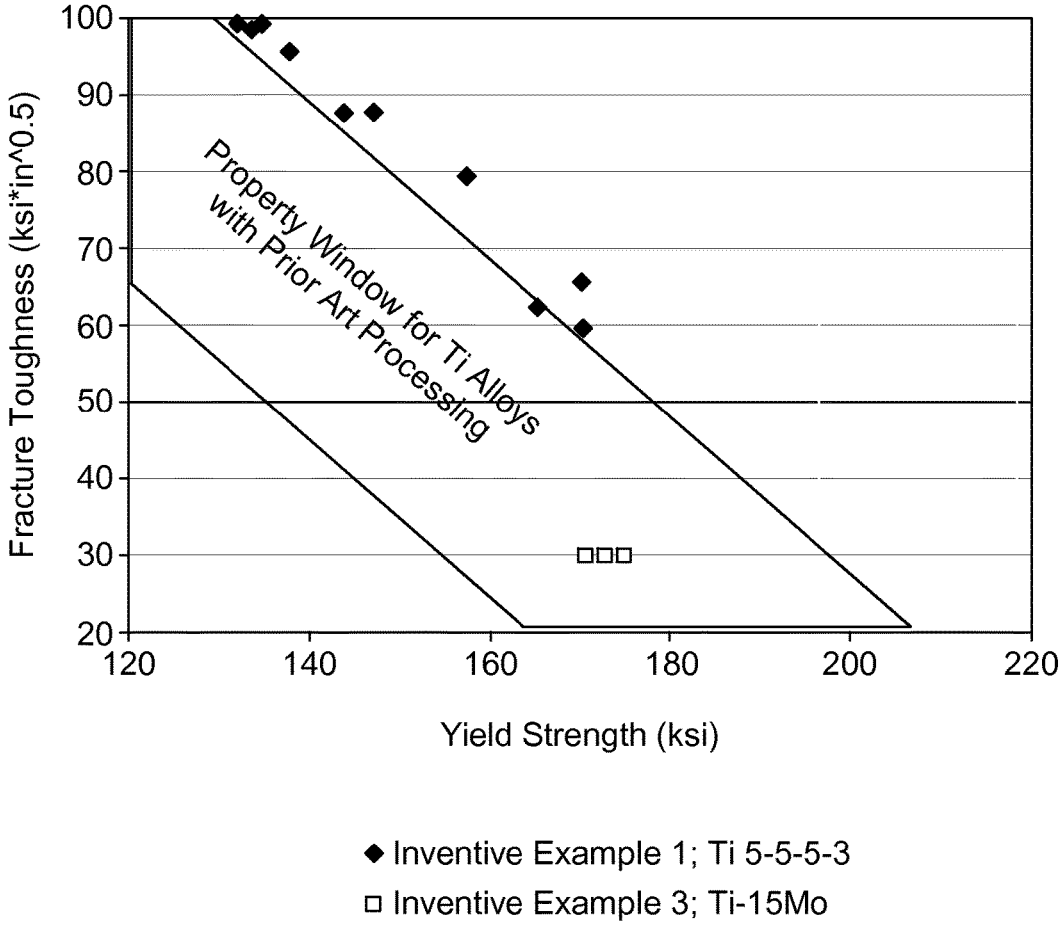
FIG. 6 is a graph of $K_{Ic}$ fracture toughness versus yield strength for titanium alloys that were plastically deformed and heat treated according to non-limiting embodiments of a method according to the present disclosure and comparing those embodiments with alloys heat treated according to prior art processes.

The useful combinations of fracture toughness and yield strength exhibited by the aforementioned alloys when processed using procedurally complex and costly prior art thermomechanical processes are presented graphically in FIG. 5. It is seen in FIG. 5 that a lower boundary of the region of the plot including useful combinations of fracture toughness and yield strength can be approximated by the line y=−0.9x+173, where "y" is $K_{Ic}$ fracture toughness in units of ksi·in$^{1/2}$ and "x" is yield strength (YS) in units of ksi. Data presented in Examples 1 and 3 (see also FIG. 6) presented herein below demonstrate that embodiments of a method of processing titanium alloys according to the present disclosure, including plastically deforming and heat treating the alloys as described herein, result in combinations of $K_{Ic}$ fracture toughness and yield strength that are comparable to those achieved using costly and relatively procedurally complex prior art processing techniques. In other words, with reference to FIG. 5, based on results achieved conducting certain embodiments of a method according to the present disclosure, a titanium alloy exhibiting fracture toughness and yield strength according to Equation (1) may be achieved.

$$K_{Ic} \geq -(0.9)\text{YS}+173 \quad (1)$$

It is further seen in FIG. 5 that an upper boundary of the region of the plot including useful combinations of fracture toughness and yield strength can be approximated by the line y=−0.9x+217.6, where "y" is $K_{Ic}$ fracture toughness in units of ksi·in$^{1/2}$ and "x" is yield strength (YS) in units of ksi. Therefore, based on results achieved conducting embodiments of a method according to the present disclosure, the present method may be used to produce a titanium alloy exhibiting fracture toughness and yield strength within the bounded region in FIG. 5, which may be described according to Equation (2).

$$217.6-(0.9)\text{YS} \geq K_{Ic} \geq 173-(0.9)\text{YS} \quad (2)$$

According to a non-limiting aspect of this disclosure, embodiments of the method according to the present disclosure, including plastic deformation and heat treating steps, result in titanium alloys having yield strength and fracture toughness that are at least comparable to the same alloys if processed using relatively costly and procedurally complex prior art thermomechanical techniques.

In addition, as shown by the data presented in Example 1 and Tables 1 and 2 hereinbelow, processing the titanium alloy Ti-5Al-5V-5Mo-3Cr by a method according to the present disclosure resulted in a titanium alloy exhibiting mechanical properties exceeding those obtained by prior art thermomechanical processing. See FIG. 6. In other words, with reference to the bounded region shown in FIGS. 5 and 6 including combinations of yield strength and fracture toughness achieved by prior art thermomechanical processing, certain embodiments of a method according to the present disclosure produce titanium alloys in which fracture toughness and yield strength are related according to Equation (3).

$$K_{Ic} \geq 217.6-(0.9)\text{YS} \quad (3)$$

The examples that follow are intended to further describe non-limiting embodiments, without restricting the scope of the present invention. Persons having ordinary skill in the art will appreciate that variations of the Examples are possible within the scope of the invention, which is defined solely by the claims.

Example 1

A 5 inch round billet of Ti-5Al-5V-5Mo-3Cr (Ti 5-5-5-3) alloy, from ATI Allvac, Monroe, N.C., was rolled to 2.5 inch bar at a starting temperature of about 1450° F. (787.8° C.), in the alpha-beta phase field. The beta transus temperature of the Ti 5-5-5-3 alloy was about 1530° F. (832° C.). The Ti 5-5-5-3 alloy had a mean ingot chemistry of 5.02 weight percent aluminum, 4.87 weight percent vanadium, 0.41 weight percent iron, 4.90 weight percent molybdenum, 2.85 weight percent chromium, 0.12 weight percent oxygen, 0.09 weight percent zirconium, 0.03 weight percent silicon, remainder titanium and incidental impurities. The final working temperature was 1480° F. (804.4° C.), also in the alpha-beta phase field and no less than 400° F. (222° C.) below the beta transus temperature of the alloy. The reduction in diameter of the alloy corresponded to a 75% reduction in area of the alloy in the alpha-beta phase field. After rolling, the alloy was air cooled to room temperature. Samples of the cooled alloy were heat treated at several heat treatment temperatures for various heat treatment times. Mechanical properties of the heat treated alloy samples were measured in the longitudinal (L) direction and the transverse direction (T). The heat treatment times and heat treatment temperatures used for the various test samples, and the results of tensile and fracture toughness ($K_{Ic}$) testing for the samples in the longitudinal direction are presented in Table 2.

TABLE 2

Heat Treatment Conditions and Longitudinal Properties

| No. | Heat Treat Temperature (° F./° C.) | Heat Treat Time (hours) | Ultimate Tensile Strength (ksi) | Yield Strength (ksi) | Percent Elongation | $K_{Ic}$ (ksi · in$^{1/2}$) |
|---|---|---|---|---|---|---|
| 1 | 1200/649 | 2 | 178.7 | 170.15 | 11.5 | 65.55 |
| 2 | 1200/649 | 4 | 180.45 | 170.35 | 11 | 59.4 |
| 3 | 1200/649 | 6 | 174.45 | 165.4 | 12.5 | 62.1 |
| 4 | 1250/677 | 4 | 168.2 | 157.45 | 14.5 | 79.4 |
| 5 | 1300/704 | 2 | 155.8 | 147 | 16 | 87.75 |
| 6 | 1300/704 | 6 | 153 | 143.7 | 17 | 87.75 |
| 7 | 1350/732 | 4 | 145.05 | 137.95 | 20 | 95.55 |
| 8 | 1400/760 | 2 | 140.25 | 134.8 | 20 | 99.25 |
| 9 | 1400/760 | 6 | 137.95 | 133.6 | 20.5 | 98.2 |

The heat treatment times, heat treatment temperatures, and tensile test results measured in the transverse direction for the samples are presented in Table 3.

TABLE 3

Heat Treatment Conditions and Transverse Properties

| No. | Heat-Treat Temperature (° F./° C.) | Heat-Treat Time (hours) | Ultimate Tensile Strength (ksi) | Yield Strength (ksi) | Percent Elongation |
|---|---|---|---|---|---|
| 1 | 1200/649 | 2 | 193.25 | 182.8 | 4.4 |
| 2 | 1200/649 | 4 | 188.65 | 179.25 | 4.5 |
| 3 | 1200/649 | 6 | 186.35 | 174.85 | 6.5 |
| 4 | 1250/677 | 4 | 174.6 | 163.3 | 4.5 |
| 5 | 1300/704 | 2 | 169.15 | 157.35 | 6.5 |
| 6 | 1300/704 | 6 | 162.65 | 151.85 | 7 |
| 7 | 1350/732 | 4 | 147.7 | 135.25 | 9 |
| 8 | 1400/760 | 2 | 143.65 | 131.6 | 12 |
| 9 | 1400/760 | 6 | 147 | 133.7 | 15 |

Typical targets for properties of Ti 5-5-5-3 alloy used in aerospace applications include an average ultimate tensile strength of at least 150 ksi and a minimum fracture toughness $K_{Ic}$ value of at least 70 ksi·in$^{1/2}$. According to Example 1, these target mechanical properties were achieved by the heat treatment time and temperature combinations listed in Table 2 for Samples 4-6.

Example 2

Figure 7A:
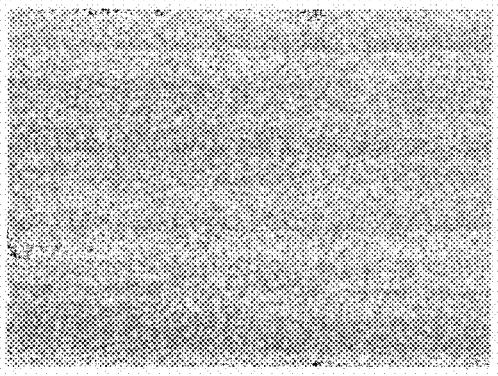
FIG. 7A is a micrograph of a Ti 5-5-5-3 alloy in the longitudinal direction after rolling and heat treating at 1250° F. (677° C.) for 4 hours.
Figure 7B:
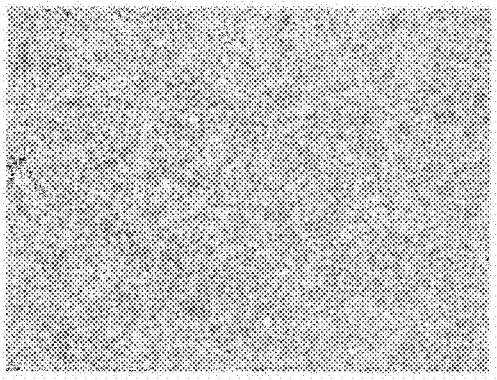
FIG. 7B is a micrograph of a Ti 5-5-5-3 alloy in the transverse direction after rolling and heat treating at 1250° F. (677° C.) for 4 hours.

Specimens of Sample No. 4 from Example 1 were cross-sectioned at approximately the mid-point of each specimen and Krolls etched for examination of the microstructure resulting from rolling and heat treating. FIG. 7A is an optical micrograph (100×) in the longitudinal direction and FIG. 7B is an optical micrograph (100×) in the transverse direction of a representative prepared specimen. The microstructure produced after rolling and heat treating at 1250° F. (677° C.) for 4 hours is a fine α phase dispersed in a β phase matrix.

Example 3

A bar of Ti-15Mo alloy obtained from ATI Allvac was plastically deformed to a 75% reduction at a starting temperature of 1400° F. (760.0° C.), which is in the alpha-beta phase field. The beta transus temperature of the Ti-15Mo alloy was about 1475° F. (801.7° C.). The final working temperature of the alloy was about 1200° F. (648.9° C.), which is no less than 400° F. (222° C.) below the alloy's beta transus temperature. After working, the Ti-15Mo bar was aged at 900° F. (482.2° C.) for 16 hours. After aging, the Ti-15Mo bar had ultimate tensile strengths ranging from 178-188 ksi, yield strengths ranging from 170-175 ksi, and $K_{Ic}$ fracture toughness values of approximately 30 ksi·in$^{1/2}$.

Example 4

A 5 inch round billet of Ti-5Al-5V-5Mo-3Cr (Ti 5-5-5-3) alloy is rolled to 2.5 inch bar at a starting temperature of about 1650° F. (889° C.), in the beta phase field. The beta transus temperature of the Ti 5-5-5-3 alloy is about 1530° F. (832° C.). The final working temperature is 1330° F. (721° C.), which is in the alpha-beta phase field and no less than 400° F. (222° C.) below the beta transus temperature of the alloy. The reduction in diameter of the alloy corresponds to a 75% reduction in area. The plastic deformation temperature cools during plastic deformation and passes through the beta transus temperature. At least a 25% reduction of area occurs in the alpha-beta phase field as the alloy cools during plastic deformation. After the at least 25% reduction in the alpha-beta phase field the alloy is not heated above the beta transus temperature. After rolling, the alloy was air cooled to room temperature. The alloys are aged at 1300° F. (704° C.) for 2 hours.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining and/or modifying any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, Applicant reserves the right to amend the claims during prosecution to add features as variously described herein.

I claim:

1. A method for increasing the strength and fracture toughness of a titanium alloy, the method consisting of:

plastically deforming a titanium alloy to an equivalent plastic deformation of at least a 25% reduction in area at a temperature starting at or above a beta transus temperature of the titanium alloy to a final plastic deformation temperature in an alpha-beta phase field of the titanium alloy and not less than 222° C. below the beta transus temperature of the titanium alloy, wherein at least a 25% reduction in area of the titanium alloy occurs in the alpha-beta phase field of the titanium alloy, and wherein after plastically deforming the titanium alloy the titanium alloy is not heated to a temperature at or above a beta transus temperature of the titanium alloy;

optionally, cooling the titanium alloy; and heat treating the titanium alloy, wherein heat treating the titanium alloy consists of a one-step heat treatment at a heat treatment temperature less than or equal to the beta transus temperature minus 20° F. for a heat treatment time sufficient to produce a heat treated alloy, wherein a fracture toughness ($K_{Ic}$) of the heat treated alloy is related to a yield strength (YS) of the heat treated alloy according to the equation:

$$K_{Ic} \geq 173-(0.9)\text{YS}.$$

2. The method of claim 1, wherein the fracture toughness ($K_{Ic}$) of the heat treated alloy is related to the yield strength (YS) of the heat treated alloy according to the equation:

$$217.6-(0.9)\text{YS} \geq K_{Ic} \geq 173-(0.9)\text{YS}.$$

3. The method of claim 1 wherein the fracture toughness ($K_{Ic}$) of the heat treated alloy is related to the yield strength (YS) of the heat treated alloy according to the equation:

$$K_{Ic} \geq 217.6-(0.9)\text{YS}.$$

4. The method of claim 1, wherein plastically deforming the titanium alloy comprises plastically deforming the titanium alloy to an equivalent plastic deformation in the range of greater than a 25% reduction in area to a 99% reduction in area.

5. The method of claim 1, wherein heat treating the titanium alloy comprises heating the titanium alloy at a heat treatment temperature in the range of 900° F. (482° C.) to 1500° F. (816° C.) for a heat treatment time in the range of 0.5 hours to 24 hours.

6. The method of claim 1, wherein plastically deforming the titanium alloy comprises at least one of forging, rotary forging, drop forging, multi-axis forging, bar rolling, plate rolling, and extruding the titanium alloy.

7. The method of claim 1, wherein the equivalent plastic deformation comprises an actual reduction in area of a cross-section of the titanium alloy.

8. The method of claim 1, wherein plastically deforming the titanium alloy results in an actual reduction in area of a cross-section of the titanium alloy of 5% or less.

9. The method of claim 4, wherein the equivalent plastic deformation comprises an actual reduction in area of a cross-section of the titanium alloy.

10. The method of claim 1, wherein the titanium alloy is a titanium alloy that is capable of retaining beta-phase at room temperature.

11. The method of claim 10, wherein the titanium alloy is selected from a beta titanium alloy, a metastable beta titanium alloy, an alpha-beta titanium alloy, and a near-alpha titanium alloy.

12. The method of claim 10, wherein the titanium alloy is Ti-5Al-5V-5Mo-3Cr alloy.

13. The method of claim 10, wherein the titanium alloy is Ti-15Mo.

14. The method of claim 1, wherein after heat treating the titanium alloy, the titanium alloy exhibits an ultimate tensile strength in the range of 138 ksi to 179 ksi.

15. The method of claim 1, wherein after heat treating the titanium alloy, the titanium alloy exhibits a $K_{Ic}$ fracture toughness in the range of 59 ksi·in$^{1/2}$ to 100 ksi·in$^{1/2}$.

16. The method of claim 1, wherein after heat treating the titanium alloy, the titanium alloy exhibits a yield strength in the range of 134 ksi to 170 ksi.

17. The method of claim 1, wherein after heat treating the titanium alloy, the titanium alloy exhibits a percent elongation in the range of 4.4% to 20.5%.

18. The method of claim 1, wherein after heat treating the titanium alloy, the titanium alloy exhibits an average ultimate tensile strength of at least 166 ksi, an average yield strength of at least 148 ksi, a percent elongation of at least 6%, and a $K_{Ic}$ fracture toughness of at least 65 ksi·in$^{1/2}$.

19. The method of claim 1, wherein after heat treating the titanium alloy, the titanium alloy has an ultimate tensile strength of at least 150 ksi and a $K_{Ic}$ fracture toughness of at least 70 ksi·in$^{1/2}$.

20. A method for thermomechanically treating a titanium alloy to increase strength and fracture toughness, the method consisting of:

working a titanium alloy at a working temperature starting from at or up to 200° F. (111° C.) above a beta transus temperature of the titanium alloy to a final temperature not less than 222° C. below the beta transus temperature of the titanium alloy and in an alpha-beta phase field of the titanium alloy, wherein at least a 25% reduction in area of the titanium alloy occurs in the alpha-beta phase field of the titanium alloy, wherein the titanium alloy is not heated above the beta-transus temperature after the at least 25% reduction in area of the titanium alloy in the alpha-beta phase field of the titanium alloy;

optionally, cooling the titanium alloy; and heat treating the titanium alloy, wherein heat treating the titanium alloy consists of a one-step heat treatment in a heat treatment temperature range between 900° F. (482° C.) and 1500° F. (816° C.) for a heat treatment time sufficient to produce a heat treated alloy having a fracture toughness ($K_{Ic}$) that is related to the yield strength (YS) of the heat treated alloy according to the equation:

$$K_{Ic} \geq 173-(0.9)\text{YS}.$$

21. The method of claim 20, wherein the heat treatment time is in the range of 0.5 to 24 hours.

22. The method of claim 20, wherein working the titanium alloy provides an equivalent plastic deformation in the range of greater than a 25% reduction in area to a 99% reduction in area.

23. The method of claim 20, wherein working the titanium alloy comprises working the titanium alloy substantially entirely in the alpha-beta phase field.

24. The method of claim 20, wherein working the titanium alloy comprises working the titanium alloy from a temperature at or above the beta transus temperature, into the alpha-beta field, and to a final working temperature in the alpha-beta field.

25. The method of claim 20, wherein the titanium alloy is a titanium alloy that is capable of retaining beta-phase at room temperature.

26. The method of claim 20, wherein after heat treating the titanium alloy, the titanium alloy has an average ultimate tensile strength of at least 166 ksi, an average yield strength of at least 148 ksi, a $K_{Ic}$ fracture toughness of at least 65 ksi·in$^{1/2}$, and a percent elongation of at least 6%.

27. The method of claim 20, wherein the fracture toughness ($K_{Ic}$) of the heat treated alloy is related to the yield strength (YS) of the heat treated alloy according to the equation:

$$217.6-(0.9)\mathrm{YS} \geq K_{Ic} \geq 173-(0.9)\mathrm{YS}.$$

28. The method of claim 20, wherein the fracture toughness ($K_{Ic}$) of the heat treated alloy is related to the yield strength (YS) of the heat treated alloy according to the equation:

$$K_{Ic} \geq 217.6-(0.9)\mathrm{YS}.$$

* * * * *